US011453565B2

(12) United States Patent
Wetsch

(10) Patent No.: US 11,453,565 B2
(45) Date of Patent: Sep. 27, 2022

(54) AUTOMATED AIR-PILLOW DISPENSER

(71) Applicant: Pregis Innovative Packaging LLC, Deerfield, IL (US)

(72) Inventor: Thomas D. Wetsch, St. Charles, IL (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 0 days.

(21) Appl. No.: 17/247,325

(22) Filed: Dec. 7, 2020

(65) Prior Publication Data

US 2021/0087010 A1 Mar. 25, 2021

Related U.S. Application Data

(60) Continuation of application No. 16/298,781, filed on Mar. 11, 2019, now Pat. No. 10,858,210, which is a (Continued)

(51) Int. Cl.
*B65H 20/00* (2006.01)
*B65B 55/20* (2006.01)

(Continued)

(52) U.S. Cl.
CPC ..... *B65H 20/00* (2013.01); *B65B 55/20* (2013.01); *B65H 20/005* (2013.01); *B65H 20/02* (2013.01);

(Continued)

(58) Field of Classification Search
CPC ..... B65B 55/20; B65H 20/005; B65H 20/02; B65H 20/06; Y10T 225/12; Y10T 225/30;

(Continued)

(56) References Cited

U.S. PATENT DOCUMENTS 3,084,839 A 4/1963 Aronson
3,660,189 A * 5/1972 Troy ..... B29C 51/225 156/145

(Continued)

FOREIGN PATENT DOCUMENTS

DE 4220342 A1 1/1993
EP 1563987 A1 8/2005
GB 2257087 A 1/1993

*Primary Examiner* — Omar Flores Sanchez
(74) *Attorney, Agent, or Firm* — Fox Rothschild LLP

(57) ABSTRACT

A transfer and dispensing apparatus is disclosed for the conveying and separation of packaging material, cushions or pillows when needed by the operator. When a packer working over a conveyor receives a box that requires void fill, an operating switch such as a foot pedal is depressed to dispense pillows from the apparatus and into the box in a connected strip. When the operating switch is released, the apparatus stops dispensing pillows, separates the continuous strip of pillows along a transverse perforation in the strip, and ejects the end of the separated segment. The packer can then complete packing the box by placing the severed end of the pillows into the box, advance to the next box, and repeat the process. The transfer and dispensing apparatus may be positioned in any convenient location including adjacent to, above or attached to the inflation device.

23 Claims, 21 Drawing Sheets

Related U.S. Application Data division of application No. 14/537,700, filed on Nov. 10, 2014, now Pat. No. 10,227,196, which is a continuation of application No. 13/584,588, filed on Aug. 13, 2012, now Pat. No. 8,881,962, which is a division of application No. 11/867,452, filed on Oct. 4, 2007, now Pat. No. 8,240,533.

(60) Provisional application No. 60/875,063, filed on Dec. 15, 2006, provisional application No. 60/866,528, filed on Nov. 20, 2006, provisional application No. 60/849,537, filed on Oct. 4, 2006.

(51) Int. Cl.
*B65H 20/02* (2006.01)
*B65H 20/06* (2006.01)

(52) U.S. Cl.
CPC ..... *B65H 20/06* (2013.01); *B31D 2205/007* (2013.01); *B31D 2205/0052* (2013.01); *B31D 2205/0058* (2013.01); *B31D 2205/0082* (2013.01); *Y10T 225/12* (2015.04); *Y10T 225/30* (2015.04); *Y10T 225/393* (2015.04)

(58) Field of Classification Search
CPC ..... Y10T 225/393; B31D 2205/0052; B31D 2205/0058; B31D 2205/007; B31D 2205/0082
See application file for complete search history.

(56) References Cited

U.S. PATENT DOCUMENTS

| | | | |
|---|---|---|---|
| 3,667,593 | A | 6/1972 | Pendleton |
| 4,017,351 | A | 4/1977 | Larson et al. |
| 4,651,506 | A | 3/1987 | Lerner et al. |
| 5,135,147 | A | 8/1992 | Granger |
| 5,158,639 | A | 10/1992 | Washazaki |
| 5,182,898 | A | 2/1993 | Tung |
| 5,261,466 | A | 11/1993 | Koyanagi |
| 5,942,076 | A | 8/1999 | Salerno et al. |
| 5,979,729 | A | 11/1999 | Schmidt et al. |
| 6,428,246 | B1 | 8/2002 | Landrum |
| 6,789,376 | B1 | 9/2004 | Greenwood et al. |
| 6,889,739 | B2 | 5/2005 | Lerner et al. |
| 6,932,134 | B2 | 8/2005 | Selle et al. |
| 6,996,955 | B2 | 2/2006 | White et al. |
| 7,165,375 | B2 | 1/2007 | O'Dowd |
| 7,273,142 | B2 | 9/2007 | Huis et al. |
| 7,550,191 | B2 | 6/2009 | Lerner |
| 7,718,028 | B2 | 5/2010 | Lerner et al. |
| 7,767,288 | B2 | 8/2010 | Lerner |
| 2005/0160699 | A1 | 7/2005 | Perkins |
| 2005/0210839 | A1 | 9/2005 | Sadakierski et al. |
| 2006/0010835 | A1 | 1/2006 | Shaw et al. |
| 2006/0090421 | A1 | 5/2006 | Sperry et al. |
| 2009/0258775 | A1 | 10/2009 | Chan et al. |

* cited by examiner

AUTOMATED AIR-PILLOW DISPENSER

CROSS-REFERENCE TO RELATED APPLICATIONS

This application is a continuation application of U.S. patent application Ser. No. 16/298,781, filed Mar. 11, 2019, which is a divisional of U.S. patent application Ser. No. 14/537,700, filed Nov. 10, 2014, now U.S. Pat. No. 10,227,196, entitled AUTOMATED AIR-PILLOW DISPENSER, which is a continuation of U.S. patent application Ser. No. 13/584,588, filed Aug. 13, 2012, now U.S. Pat. No. 8,881,962, which is a divisional of U.S. patent application Ser. No. 11/867,452, filed Oct. 4, 2007, now U.S. Pat. No. 8,240,533, which claims the benefit of U.S. Provisional Application No. 60/849,537, filed Oct. 4, 2006, U.S. Provisional Application No. 60/866,528, filed Nov. 20, 2006, and U.S. Provisional Application No. 60/875,063, filed Dec. 15, 2006. The content of each of these applications is hereby incorporated herein by reference thereto.

FIELD OF THE INVENTION

The present invention relates to packaging materials and more particularly is directed to systems and methods used in the manufacturing and utilization of packaging pillows.

BACKGROUND OF THE INVENTION

Many techniques have been used to pack items for shipping and to absorb impacts on goods that are packed for shipping. Popular shipping protection methods includes the use of foam "peanuts," molded foam components, formed paper, and molded pulp packaging components.

A technique that has gained recent popularity involves the use of air-inflated cushions formed from a film material ("pillows"), such as disclosed in U.S. Pat. No. 6,932,134 and pending application Ser. No. 11/185,927. This style of packaging allows low-volume, uninflated pillow film materials to be shipped to packers, who then inflate the pillows as needed into shock-absorbing packing material. Pillow inflating machines may be used at the point of packaging to provide fully formed pillows at the time of packaging, thereby eliminating the need to store bulky packaging materials at the packaging site. The inflated pillows are formed in a continuous strip of individual pillows, and the desired length or number of the inflated pillows are separated from the continuous strip of inflated pillows as they are dispensed from the pillow inflating machine.

Air inflating machine systems may produce the air-inflated pillows at a rate that differs from the rate at which the actual packaging of goods is occurring. To accommodate the differences in the rate of pillow inflation and packaging use, the strip of formed packaging material is often fed into a holding bin adjacent to the inflation device. When packing material is needed by the packer, the end of the continuous strip of inflated pillows is withdrawn from the holding bin, an appropriate length of inflated pillows is measured by the packer, separated from the continuous strip and then placed into a shipping box to protect the packaged goods.

When a packer is using the pillows as packaging material, he must pull the required material out of the holding bin, typically using both hands to pull and place a number of pillows into the shipping box to fill any voids that may be present. When a sufficient number of pillows have been placed in the box to fill the voids, the packer must separate the pillows from the continuous strip of pillows. The need for the packer to reach into the holding bin and manually separate the required length or number of inflated pillows can be a time-consuming and laborious process, decreasing the overall efficiency of the packaging operation and thereby increasing costs. In some applications, a transfer stand may be placed in front of the holding bin with the end of the continuous strip of pillows draped over the transfer stand so that the packer does not have reach into the holding bin every time additional pillows are required. However, this still requires the packer to manually pull and tear the required number of pillows for packaging. A device is needed that can facilitate and improve the efficiency of dispensing air-inflated pillows to aid the packer in the packaging operation.

SUMMARY OF THE INVENTION

According to one embodiment of the present invention, a transfer and dispensing apparatus conveys and separates packaging material, cushions or pillows when needed by the operator. When a packer working over a conveyor receives a shipping box that requires void fill, an operating switch such as a foot pedal is depressed to dispense pillows from the apparatus and into the box in a connected strip. When the operating switch is released, the apparatus stops dispensing pillows, separates the continuous strip of pillows along a transverse perforation in the strip, and ejects the end of the separated segment. The packer can then complete packing the box by placing the severed end of the pillows into the box, advance to the next box, and repeat the process. The transfer and dispensing apparatus may be positioned in any convenient location including adjacent to, above or attached to the inflation device.

The invention relates to a packing material transfer apparatus. A preferred embodiment of the transfer apparatus includes a plurality of traction members, such as grippers, that are configured for gripping a chain of pre-inflated pillows, which are connected to each other end to end. A driving mechanism is operably associated with the traction members to drive the traction members for drawing the chain from an input location to an output location, in which the pillows are dispensed. Additionally, a motor is configured for powering the driving mechanism. The preferred traction members are spaced at a pre-determined distance from each other, which distance corresponds to the position of recessed zones along the chain, for example, zones between the inflated pillows, such that the traction members are received within the recessed zones to engage and move the chain.

A guide surface can be provided, which is configured for guiding the pillows therealong, and the driving mechanism can be configured for moving the traction members along a path adjacent to the guide surface for trapping the pillows therebetween. The guide surface can be stationary or movable and can be arcuate or have another suitable shape. The driving mechanism can include a drum to which the traction members are mounted to drive the traction members along a curved, and preferably circular path, such as when using an arcuate guide surface.

The guide surface is preferably driven for moving the chain cooperatively with the traction members. In one embodiment, the guide surface and traction members include rollers or driven belts, preferably extending on opposite sides of a longitudinal axis of the chain, and which can be arranged as conveyers.

The preferred transfer apparatus preferably includes a detachment mechanism that is configured for detaching at least one of the pillows from the chain. The detachment mechanism can have a detachment element that is operable to break a weakened area between the adjacent pillows and the chain to separate the pillows from each other. The detached pillows can be dispensed at the output location. In a preferred embodiment, the detachment element includes at least one cutter configured to rotate through the weakened area to separate adjacent pillows. Preferably, the cutter includes first and second cutters configured to rotate in opposite directions to cooperatively pull material of the chain of pillows around the weakened area against the cutters.

A pillow detector can also be provided for detecting the position of individual or groups of pillows in the chain. The detector is preferably connected for operating the detachment element to detach at least one pillow from the chain, in which this operation is activated based on the detected positions of the pillows. The pillow detector can include a follower configured and positioned to follow contours of the pillows to detect the positions thereof. In one embodiment, the pillow detector includes a vacuum source configured to detect changes in vacuum depending on the region of the chain associated therewith as the chain is moved in relation thereto, thus enabling the vacuum source to be used to determine the positions of the pillows.

The traction members of one embodiment include nip elements to grip the chain by nipping it. The driving mechanism can be configured to rotate the nip elements for drawing the chain towards the output location. Furthermore, the nip elements can include rollers and conveyers, for example.

The traction members can include forward and aft traction members, with the driving mechanism configured for operating the forward and aft traction members at different speeds, such as by stopping one and moving the other or by moving each in different directions, to detach detachment of at least one pillow from the chain. Also, the driving mechanism can be configured for operating the forward and aft traction members at different speeds to initiate a tear between the pillow or pillows to be detached and the remainder of the chain at one or both of the lateral sides of the chain, so that the tear can continue across the remainder of the area between the pillows to be detached and the remainder of the chain. In one embodiment, a pillow chain transfer system is provided, in which two or more transfer apparatuses can be disposed and associated with respect to each other for transferring the chain from the output location of one of the transfer apparatuses to the output location to another of the transfer apparatuses.

Consequently, the invention provides a device that facilitates and improves the efficiency in handling chains of inflated pillows, which can be used for protecting packaged articles.

DETAILED DESCRIPTION OF THE PREFERRED EMBODIMENT

Figure 1:
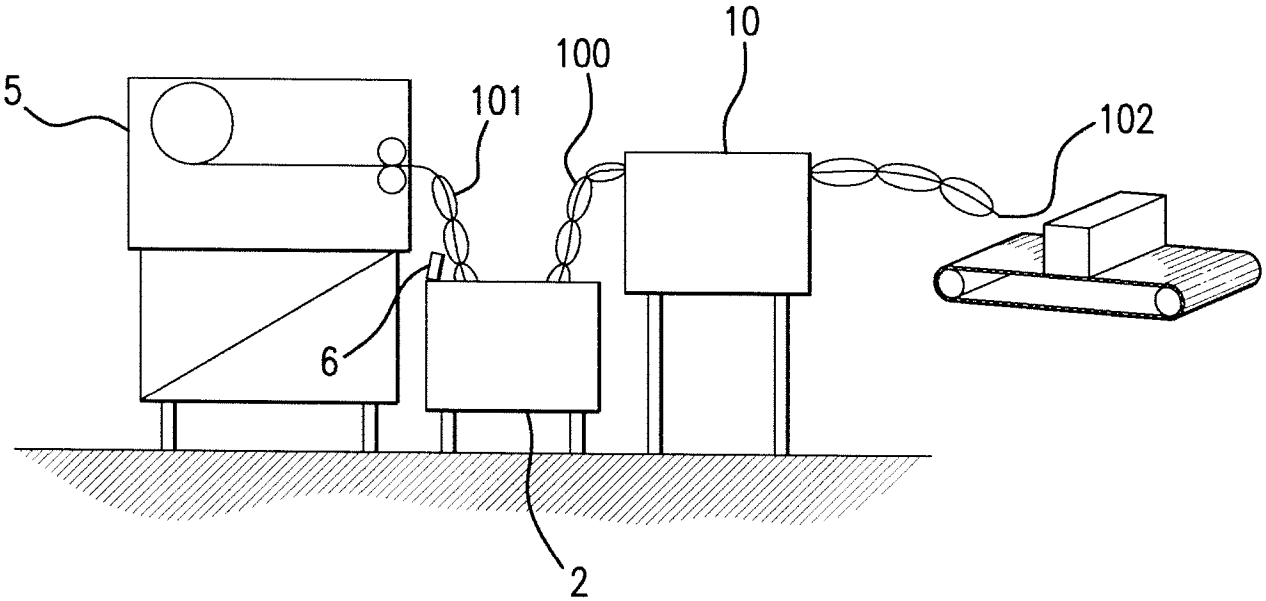
FIG. 1 is a side view of an automated transfer and dispensing apparatus in use alongside other components of an air inflated packaging pillow system.

In FIG. 1, a preferred embodiment of the transfer and dispensing apparatus 10, which can be configured as an air-pillow burster, is shown positioned adjacent to and above the location of a holding bin 2. The holding bin 2 may be used to collect pillows 101 as they are inflated and sealed by a pillow inflation and sealing device 5, for example, as disclosed in U.S. Pat. No. 6,932,134, the disclosure of which is incorporated herein by reference. Preferably, the pillows are only filled with a fluid, and more preferably a gas, such as air, and most preferably do not contain a substantial amount of solids therein. As inflated pillows 101 are formed by the pillow manufacturing devices, they fall into the holding bins in a continuous strip 100. A sensor 6 associated with the holding bin 2, may be used to identify the amount of inflated pillows 101 that have accumulated in the holding bin 2 or when the holding bin 2 is filled to a predetermined level, and give appropriate instructions to control the manufacture of additional pillows, such as by interrupting the making of pillows 101 by the pillow manufacturing device 5.

Figure 20:
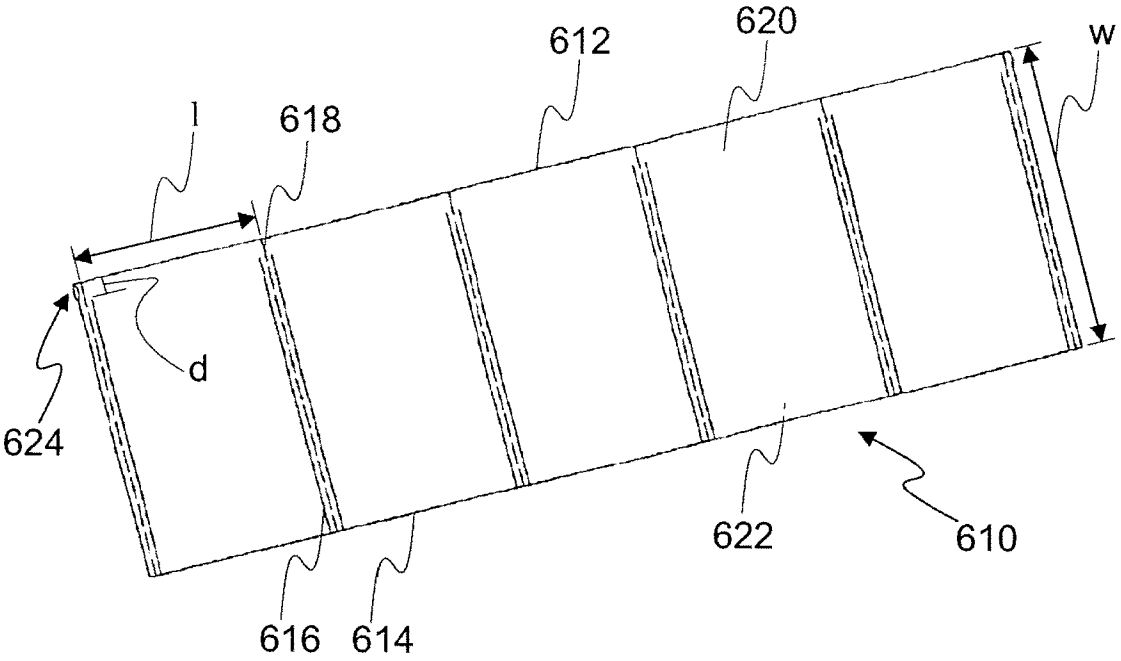
FIG. 20 is a top view of a typical web material used to form inflated pillows.

FIG. 20, shows atypical web or strip 610 of uninflated material to be inflated and sealed into a series of pillows attached at perforated edges. The web 610 may be made of a variety of different materials, including materials such as polyethylene resins such as LDPE, LLDPE, HDPE; metallocenes; EVAs; and blends thereof, The web 610 has a top edge 612 and a bottom edge 614, both of which are closed. The web 610 includes generally transverse seals 616 and generally transverse perforations 618. The transverse seals 616 join a top sheet 620 of the web 610 to a bottom sheet 622 of the web 610 along the seals 616, while the transverse perforations 618 perforate the web through the top and bottom sheets 620 and 622. According to the embodiment shown, the transverse seals 616 begin at the bottom edge 614 of the web 610 and extend to a distance d from the top edge 612. The web 610 has a width w, and a perforation to-perforation length 1, which may be altered depending on the particular type of pillow to be manufactured.

While inflated pillows 101 continue to accumulate in the holding bin 2, the free end 102 of the continuous strip of inflated pillows 100 is drawn out of the holding bin 2 by the transfer and dispensing apparatus 10, which is preferably configured to dispense the free end 102 of pillows 101 to the operator when needed. The sensor 6 on the holding bin 2 can limit the transfer of inflated pillows 101 out of the holding bin 2 when supplies are low to prevent premature tearing of the continuous strip of pillows 100.

Figure 2B:
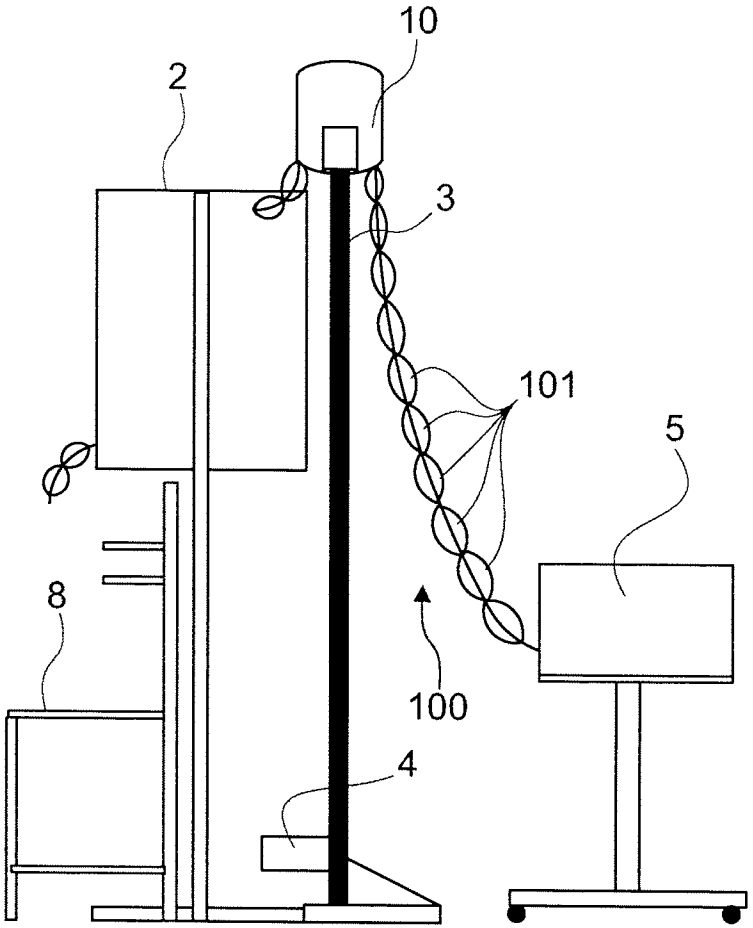
FIGS. 2A and 2B are side views of another configuration of an air inflation packaging pillow system, with the automated transfer and dispensing apparatus in the lowered and raised positions, respectively.
Figure 2A:
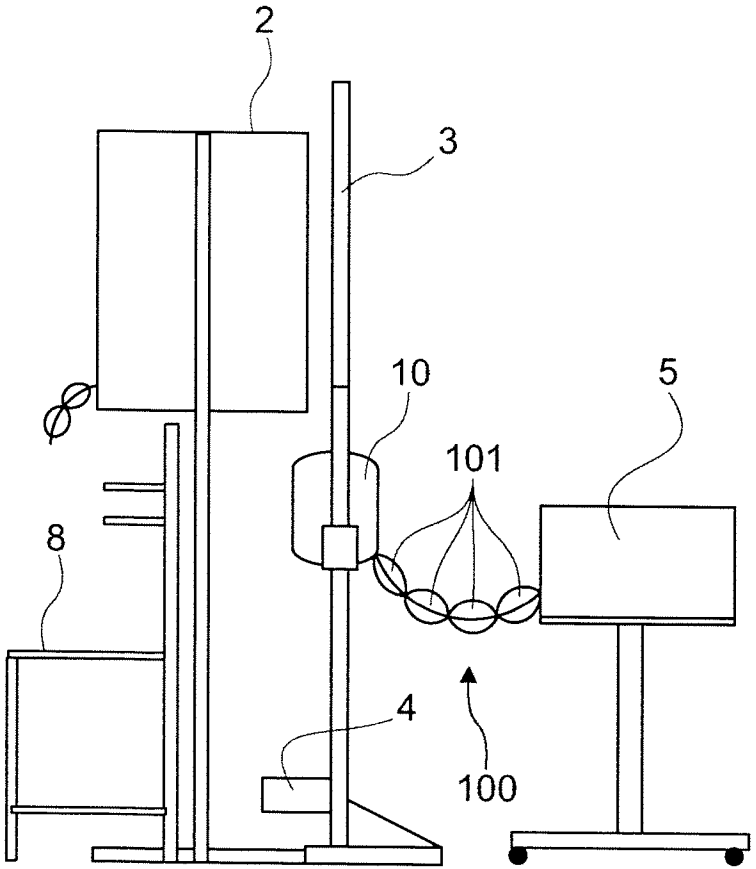

FIGS. 2A and 2B show another preferred embodiment of the transfer and dispensing apparatus 10, shown as part of a larger air inflation packaging pillow system. FIG. 2A shows a pillow inflation and sealing device 5 forming a strip of pillows 100, which is fed into one end of the transfer and dispensing apparatus 10. In this embodiment, the apparatus 10 is associated with, and preferably moveably mounted on, a support, such as an upright member, which is preferably a pole 3. A drive mechanism is preferably associated with the apparatus 10 and the pole 3, and configured for controlling movement of the apparatus 10 up and down the pole 3. The drive mechanism can be manually driven, such as by a pulley and lever system, or the drive mechanism can be powered, such as by an electric motor 4, and can use other systems, such as a worm gear, powered pulleys, and actuators, such as pneumatic or hydraulic. In FIG. 2A, the apparatus 10 is shown in the lowered position with respect to the pole 3 such that the lead end of the formed strip of pillows 100 can be easily fed into the apparatus by a standing or sitting operator, the loading position preferably being between about 2 and 7 feet off the floor.

As shown in FIG. 2B, the apparatus 10 is raised to a height on the pole 3 that is about at least as high as the top of a pillow holding bin 2, which in this embodiment is positioned above a work station or assembly bench 8. In this position, the apparatus 10 can dispense strips of pillows 100 in desired lengths for storage in the holding bin 2. Then, as a packer works at the assembly bench 8 to pack a package, the packer merely needs to reach into the bin, such as into an opening at the bottom of the holding bin 2 that is conveniently located above the assembly bench to retrieve multiple strips of pillows 100 as desired.

The transfer and dispensing apparatus 10 can alternatively be placed in a position away from either the pillow manufacturing device 5, the holding bin 2, or both. For example, a conveyor mechanism can be used to transfer the continuous strip of inflated pillows 100 from the inflation machine 5 to a holding bin 2 located some distance away. From there, the pillows 101 can be dispensed for availability to the packer.

Figure 3:
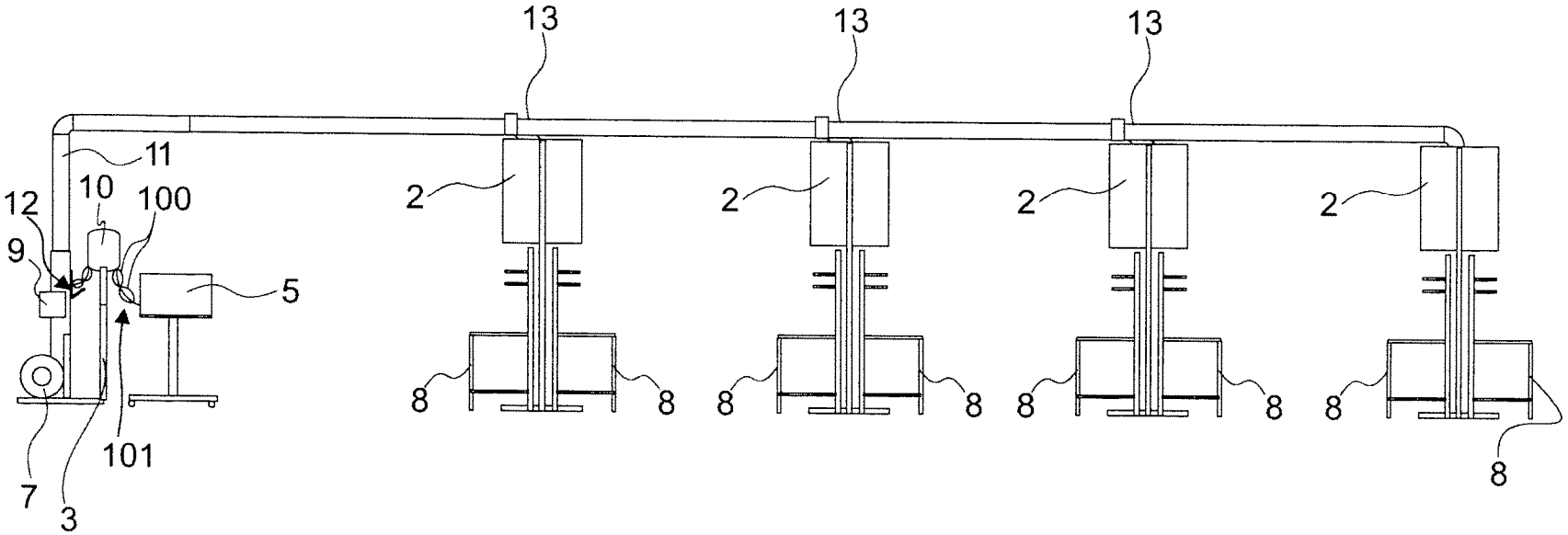
FIG. 3 is a side view of another configuration of an air inflation packaging system.

As shown in FIG. 3, for example, one or more of the apparatuses 10 can be positioned in a system to convey pillows 101 to a remote location from the pillow manufacturing device 5. The transfer apparatus 10 in FIG. 3 is associated with an inflation and sealing device 5 for forming the strip of pillows 100, and a conveyor mechanism that preferably includes a pneumatic duct or conveyer shaft 11, a pillow transport mechanism such as a blower 7, and a controller 9, which are preferably configured to transport strips of pillows to various remotely located holding bins 2. The shaft 11 preferably extends to a height at least above the top of the holding bins 2 for dispensing the strip of pillows 100 therein, preferably leaving sufficient height thereunder for operators to walk pass. Positioning the shaft 11 at this elevated height advantageously allows the shaft to be clear of the working area below, which can be used for another processes or as a throughway for packages, machinery or people. The conveyer preferably provides at least about 6.5 feet for operators to walk thereunder, although more or less can alternatively be provided, such as in embodiments in which it is not desired to provide a walkway thereunder. At least one diverter 13 is associated with the shaft 11, preferably adjacent to a holding bin 2, and configured for diverting a strip of pillows from the shaft 11 into the holding bin 2.

In this configuration, the system can transport desired lengths of pillow strips 100 to remote holding bins 2 for storage therein. For example, the apparatus 10 can deliver a strip of pillows 10 into the shaft 11, for example through shaft opening 12, and the controller 9 can control the blower 7 to transport the strip 100 through the shaft. The controller 9 also preferably controls the diverters 13 to determine to which holding bin the strip of pillows is delivered, and the diverters are configured to direct the pillows conveyed through the shaft into the selected bin. Thus, the system can maintain and refill the amount of pillows strips 100 that are contained in multiple holding bins located remotely from the transfer and dispensing apparatus 10 and inflation and sealing device 5. An alternative embodiment employs other types of conveyers, for example using conveyer belts to move the pillows.

Figure 4:
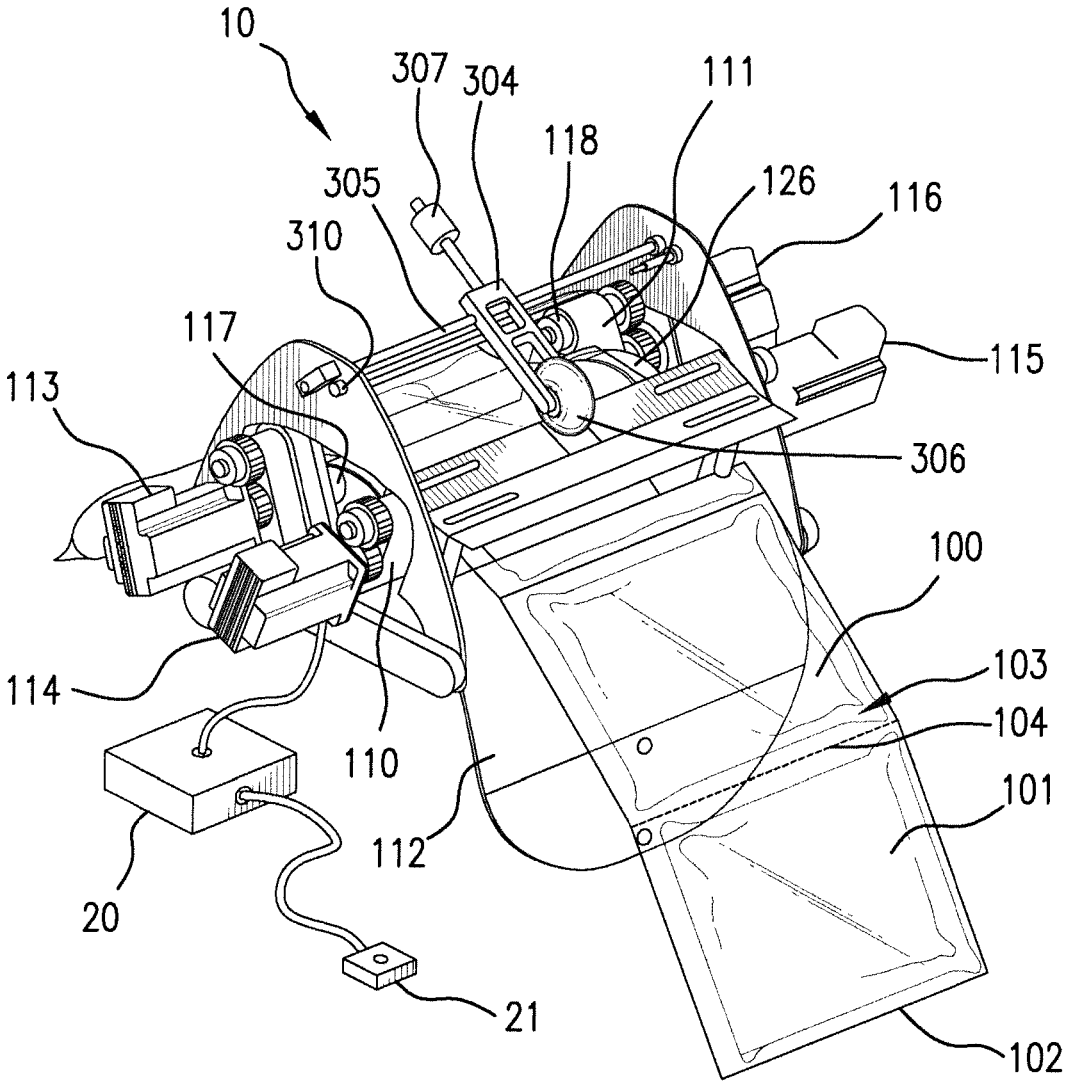
FIG. 4 is a perspective view of a preferred embodiment of an air inflation packaging pillow system.
Figure 5:
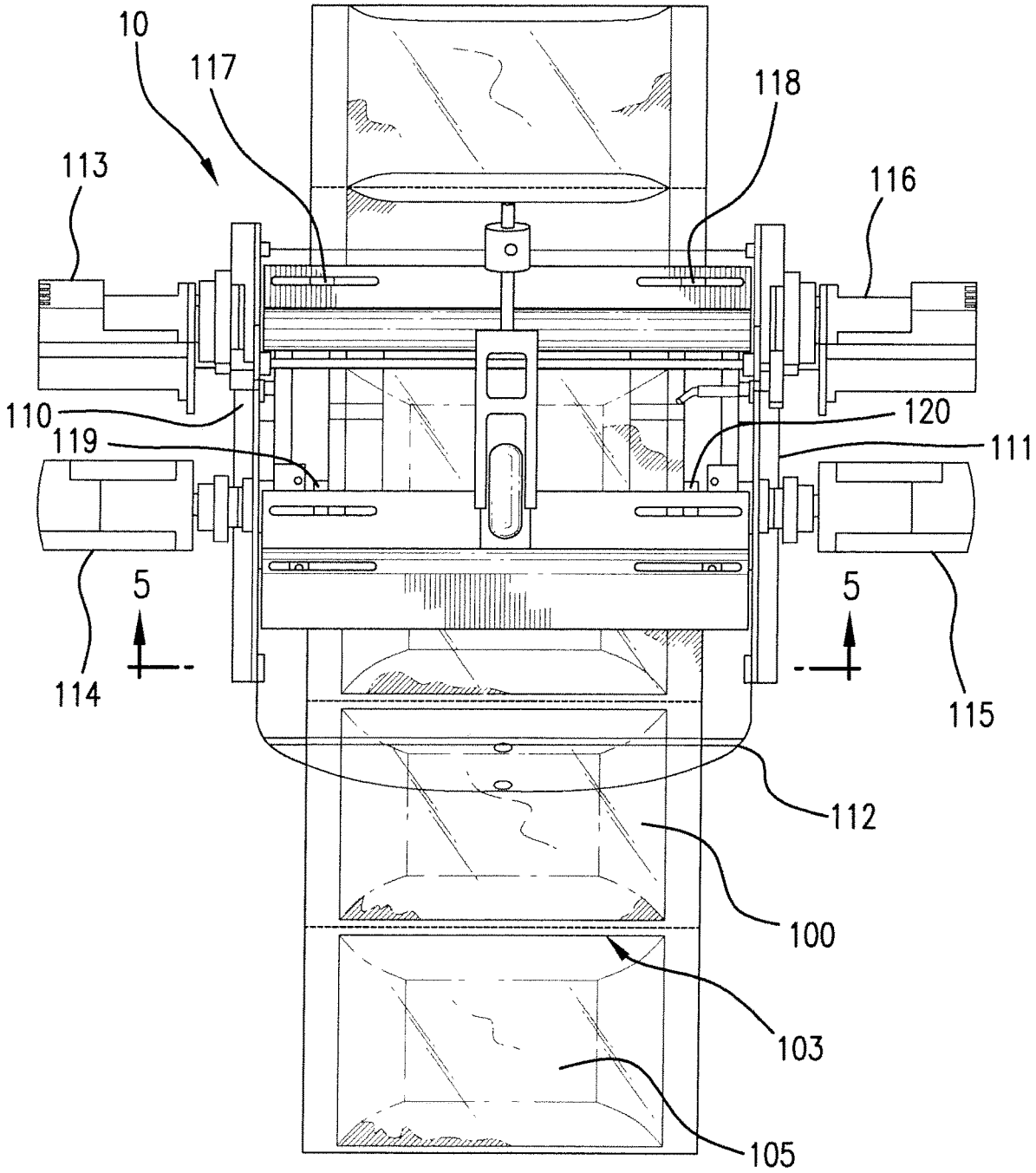
FIG. 5 is a top view thereof.

As shown in FIGS. 4 and 5, the preferred embodiment of the transfer and dispensing apparatus 10 includes first and second motor support mounts 110,111 arranged on opposite sides of a pillow support and guide saddle 112. The motor support mounts 110,111 hold one or more motors, and preferably two motors 113,114 and 115,116 each, with each motor connected to and driving a pillow engagement or traction member, such as a pair of nip rollers 117,118. The nip rollers 117,118 are configured to grip the edge of the pillows 101 in order to move and manipulate the continuous strip of pillow material 100 as it is drawn through the apparatus 10 and dispensed to the user. Each nip roller 117,118 can be driven directly by a motor 113-116, or can be driven through a gearing mechanism. Other configurations for driving the nip rollers are well known and within the knowledge of those of skill in the art.

An infeed/intake/inlet section 121 (shown in FIG. 5) of the apparatus 10 is located adjacent to the feed nip rollers 117,118 and is tapered or flared to provide a smooth transition section from the holding bin 2. The taper of the infeed section 121 allows the continuous strip of pillows 101 to be drawn from the holding bin 2 without catching, breaking or tearing, for example. The infeed section 121 is adjustable in both height and width to allow for pillows of differing inflated thickness and width. As it is drawn through the apparatus 10, the continuous strip of inflated pillows 100 may rest on or be guided by the pillow support saddle 112. The support saddle 112 may be arcuately shaped to match the contour of the continuous strip of pillows 100 as it is drawn from the holding bin 2. An edge guide plate 126 defines a path for the edges of the pillows 101 through the apparatus 10, and may be supported by the motor support mount 110,111 in a position between the feed nip rollers 117,118 and the dispensing nip rollers 119,120.

The motors 113-116 operate at variable speeds and directions, and are controlled by a motor controller 20. The motor controller 20 controls the speed and direction of rotation of each of the motors 113-116. The motor controller 20 may receive instructions from the user via an operating switch, such as a foot pedal 21. The motor controller 20 may also receive instructions from other components of the system. For example, the above disclosed sensor 6 mounted on the holding bin 2 could instruct the motor controller 20 to stop the apparatus 10 from withdrawing pillows 101 from the holding bin 2 when the number of inflated pillows 101 is low.

Depending upon the desired function, the motor controller 20 coordinates the motors so that they work in unison to drive the pairs of nip rollers 117-120 in a way to manipulate the movement of pillows 101 in a desired manner. For example, the nip rollers 117120 can be driven in unison so that the continuous strip of pillows 100 is drawn from the holding bin 2, transferred through the apparatus 10, and dispensed directly to the user in a continuous, steady rate for as long as the foot pedal 21 is depressed. Then, when the desired number of pillows 101 have been dispensed, the operator releases the foot pedal 21 and the nip rollers 117-120 are driven in a manner so that the feed nip rollers 117,118 rotate in one direction while the dispensing nip rollers 119,120 rotate in the opposite direction so as to pull the strip of pillows 100 apart and thus separate a desired length or number of pillows 101 from the continuous length of pillows 100. Once separated, the dispensing nip rollers 119,120 can dispense the separated segment of pillow packaging material to the user. The left and right feed and/or dispensing rollers can also move at different speeds to initiate a tear on one side. Also, the infeed rollers 117,118 can move in reverse to help tear the chain of pillows 101.

In the operation of the preferred embodiment, as the segment of pillows 101 is separated from the continuous strip 100 and dispensed from the apparatus 10, the feed nip rollers 117,118 maintain the position of the leading edge 102 of the remaining continuous strip of pillows 101, and keep it from falling back into the bin 2 or out of the apparatus 10. The feed nip rollers 117,118 then advance the leading edge 102 of the continuous strip 100 forward, the dispensing nip rollers 119,120 grip the leading edge 102 of the strip of pillows, and the apparatus 10 is again ready to dispense pillows for the packing of the next box.

As shown in FIGS. 4 and 5, the preferred embodiment of the apparatus 10 can use a follower arm 304 as the pillow position detector to identify the location of the perforation 104 between pillows 101 so that the strip 100 may be separated. The follower arm 304 is mounted on a transverse shaft 305 extending between the first and second motor support mounts 110,111, and can swivel about the axis of the transverse shaft 305. The transverse shaft 305 can be engaged to the follower arm 304 so that the shaft 305 also rotates about its longitudinal axis as the follower arm 304 swivels. A follower wheel 306 is located at the end of the follower arm 304 and is able to roll over the inflated pillows 101 and follow the contour of the pillows as they move through the apparatus 10. As the follower wheel 306 rolls along the contour of the pillow 101, the wheel 306 will rise along the inflated pillow portions 105 and descend into the valleys 103 at the transverse borders between the pillows 101. A spring, such as a coil spring, can be mounted on the transverse shaft 305 to dampen unwanted oscillations in the follower arm 304 as it swivels, and to keep the follower wheel 306 pressed against the surface of the pillows. A counterweight 307 mounted on the follower arm 304, on the end opposite the follower wheel 306, may be used to counteract the weight of the follower wheel 306 and arm 304, thereby keeping the follower arm 304 in balance about the transverse shaft 305.

A sensor 310 mounted at or near the end of the transverse shaft 305 may respond to rotation of the shaft to send a signal to the motor controller 20 to signal when the follower wheel 306 is located in one of the valleys 103 between pillows 101. Upon receiving the signal, the motor controller 20 can stop the dispensing of pillows 101. Thus, when the operator releases the foot pedal 21 or otherwise indicates that sufficient pillows have been dispensed, the driving mechanism stops the strip of pillows 100 at the location of the perforation 104 between the pillows, allowing the segment of pillows to be separated by the driving mechanism or one of the other identified separation mechanisms.

Figure 6:
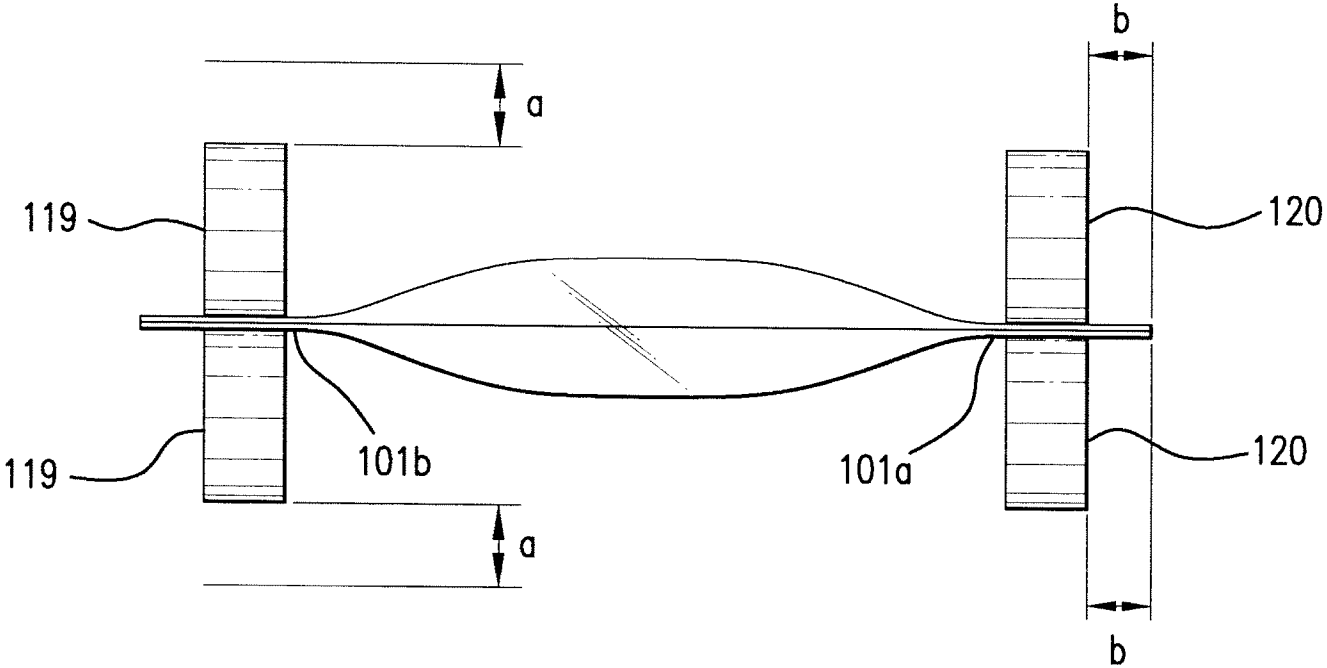
FIG. 6 is a cross-sectional, diagrammatic view of components of the automated transfer and dispensing apparatus at section 5-5 as identified in FIG. 5.

As shown in FIG. 6, the nip rollers can be adjusted in relation to one another, such as in horizontal and vertical directions "a" and "b," for example, to accommodate for differences in height and width of the pillow film material, and for feeding material into the apparatus 10. The nip rollers can also be positioned and spaced to squeeze the lateral sides 101*a*, 101*b* of inflated portion of the pillows 101 in a manner so as to fully pressurize or increase the pressurization of at least the center section of the inflated pillow 101 as it is drawn through the apparatus 10. As further discussed below, this increases the height and rigidity of the pillows, and can ensure that at least the center section 105 of the pillow 101 is fully formed, which is useful for purposes of identifying the position of individual pillows 101 as the continuous strip of pillows 100 is being drawn through the apparatus 10.

Typically, and for a variety of reasons, during the inflation of the pillows 101, the film material is not fully inflated. In one embodiment, as the follower wheel 306 presses down on the pillows 101, the wheel 306 displaces all of the air inside the pillow off to the side of the wheel 306 by providing a stiffer bias of wheel against the pillows. In one embodiment, a wheel is fixed so it does not rise and fall along the contour of the inflated pillow, for example, but this would prevent the follower wheel from locating the spaces or perforation between the pillows. Having the inflated pillows 101 squeezed by the nip rollers as described above can assist in keeping the contour of the pillows fully defined to provide a distinct height differential between the location of the pillows and the transverse border between the pillows where the film material may be perforated.

Figure 7:
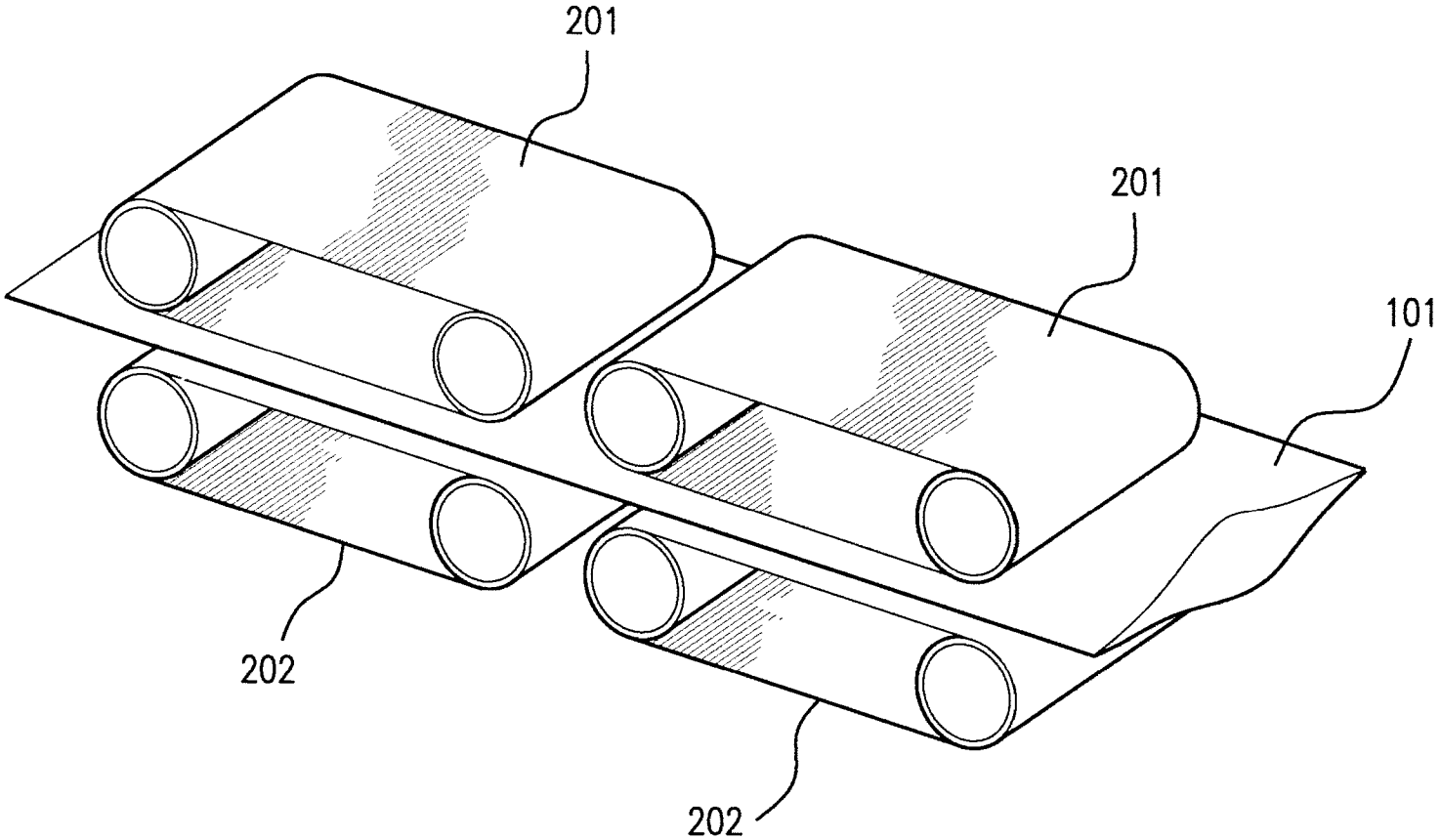
FIGS. 7 and 8 are perspective views of components of other embodiments of automated transfer and dispensing apparatuses.
Figure 8:
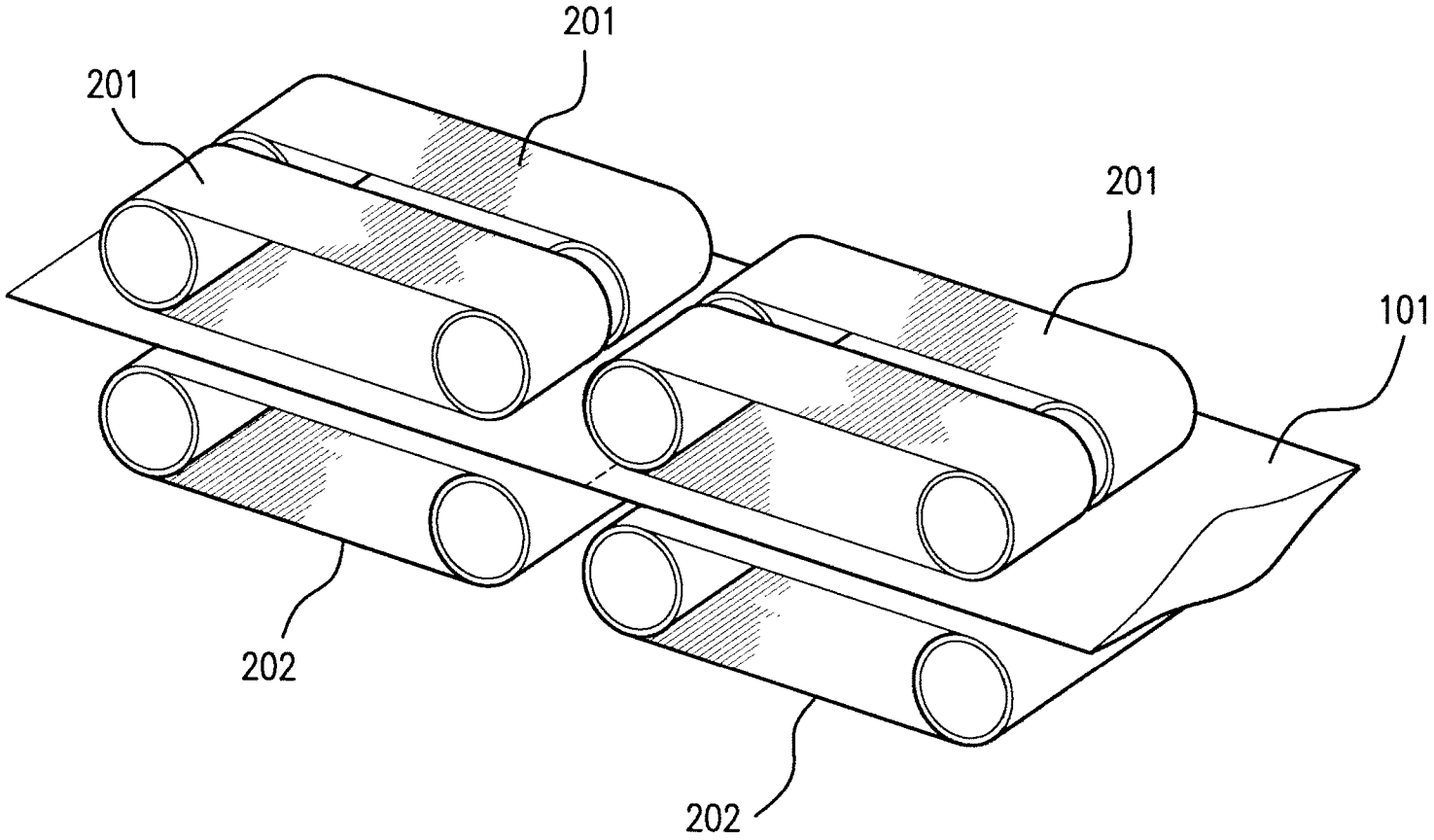

In other embodiments of the invention, other types of traction members, such as other types of rollers, wheels or drive belts, can be used to grip and move the continuous strip of pillows. In another embodiment shown in FIG. 7, top drive belts 201 and bottom drive belts 202 cooperate to move and manipulate the pillows 101. The bottom drive belts 202 may be fixed in position while the top drive belts 201 can be adjustable to accept pillows 101 of differing heights. Together, the top and bottom belts 201,202 squeeze the pillows 101 to grip them and rotate to move them. The drive belts 201,202 can also move independently of each other in order to manipulate the pillows 101 as desired. For example, as shown in FIG. 8, the apparatus may have four bottom belts 202 and four top belts 201, generally positioned to engage the corners or quadrants of a pillow 101, and can move in unison to drive the strip of pillows 100 forward. The belts 201,202 can also move differentially to apply a tearing force to just one edge of the strip of pillows 100 or hold the strip of pillows in position while a segment of pillows 101 is separated and dispensed from the apparatus 10.

Other mechanisms can also be incorporated into the apparatus to draw the continuous strip of pillows 100 from the holding bin 2 and move it through the device 10. In one embodiment, a ducted conveyor (not shown) that uses forced air-flow or differential air pressure to move the strip of pillows 100 through the machine is used. The ducted conveyor includes a duct where streams of air are directed at the pillows 100 to blow them through the apparatus. Alternatively, a duct incorporating a low pressure area can also be used to draw the pillows into the apparatus.

In other embodiments of the invention, different numbers of motors and mechanisms for driving the nip rollers or belts can be incorporated. For example, a single motor can drive the feed rollers in unison while two or more motors are used to achieve the differential rotation required for the tearing and dispensing of a segment of pillows. In another embodiment, all of the nip rollers are driven by a single motor via a differential transmission that can independently control each nip roller. Additional motors can also be added to convey the pillow material through the apparatus, or for other functions as required.

In separating the segment of pillows 101 from the continuous strip of pillows 100 being drawn from the holding bin 2, the nip rollers can be coordinated and driven in a manner so as to differentially tension one edge of the continuous strip of pillows 100 while leaving the other edge slack to start a tear at one edge of the strip of pillows at the desired location for separation, and then separate the pillow segment from the continuous strip. A locking mechanism can also be incorporated to lock one or more of the nip rollers, thereby holding an edge to achieve the same result of tearing and separating the pillows.

In another embodiment of the invention, a segment of the continuous strip of pillows 100 can be separated by a break bar, such as break bar 302 (shown in FIG. 9) that operates on one or both of the edges of the strip, or between the edges, to start a tear at the perforation 104 located between the pillows 101, making it easier for the drive system to pull the pillows apart or causing the tear. When the strip 100 reaches the proper position for separation, the nip rollers stop rotating and hold the material in position at the location of the break bar 302. An actuator 303 moves the break bar 302 against the strip 100 to initiate tearing of the material between the pillows 101. The break bar 302 can have multiple points that are driven through the material at the perforation 104. In another embodiment of the invention, separation of the strip 100 is accomplished by one or more stoppers, such as break bar 302, that preferably move up against the film material just before the point of desired separation and clamp the material against a plate on the opposite side or block the moment of the pillows 101 behind the stopper. With the strip 100 clamped or otherwise stopped by the stoppers, the dispensing nip rollers tear off the segment of pillows, and then dispense the segment to the operator.

Figure 10:
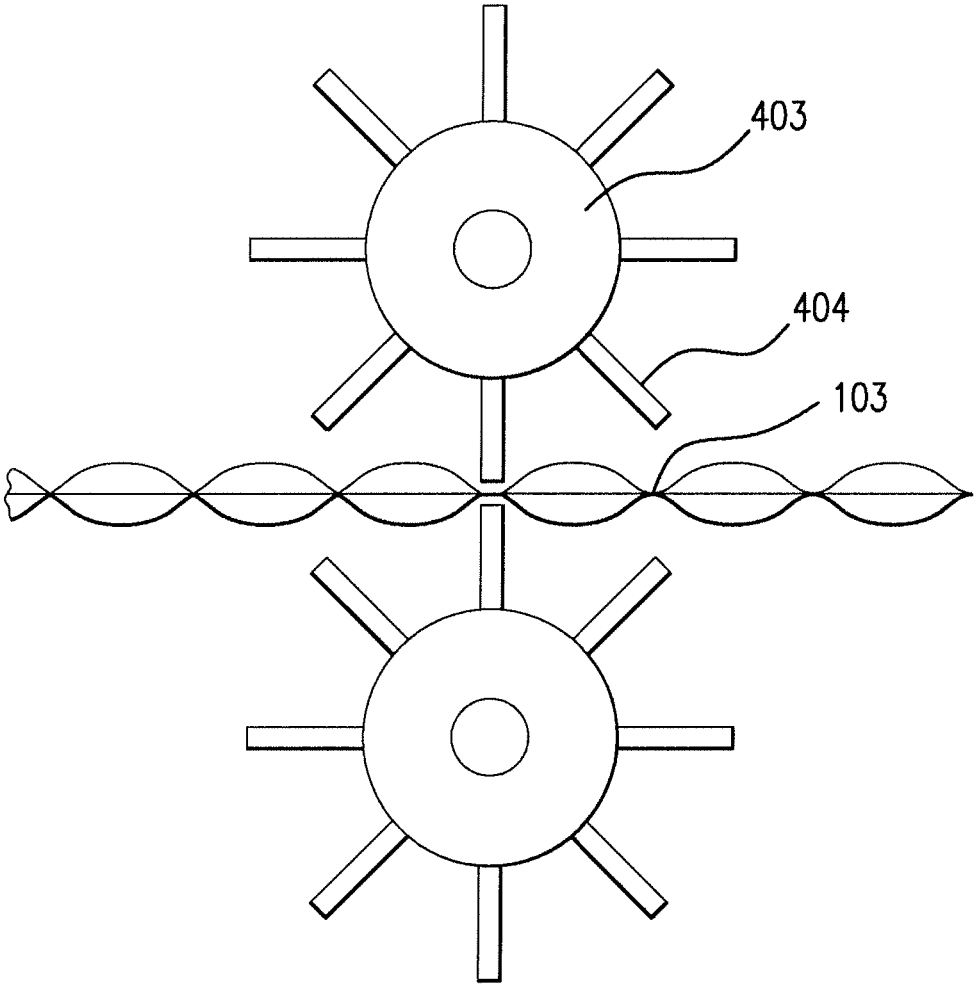

Another embodiment of the invention incorporates traction members that include paddles 404 mounted on rotors 403 that may rotate so that the paddles translate into the valley 103 between pillows to engage the inflated portion of a pillow, as shown in FIG. 10. A pair of rotors with associated paddles 404 can be mounted above and below the path of the continuous strip of pillows 101. The paddles 404 can move the pillows 101 forward, or fix the pillows in position to separate a segment of the pillows from the continuous strip 100. The paddles 404 can alternatively work independently of each other so that while one paddle holds the continuous strip of pillows 101, the other paddle tears off and dispenses a segment of the pillows 101.

Figure 9:
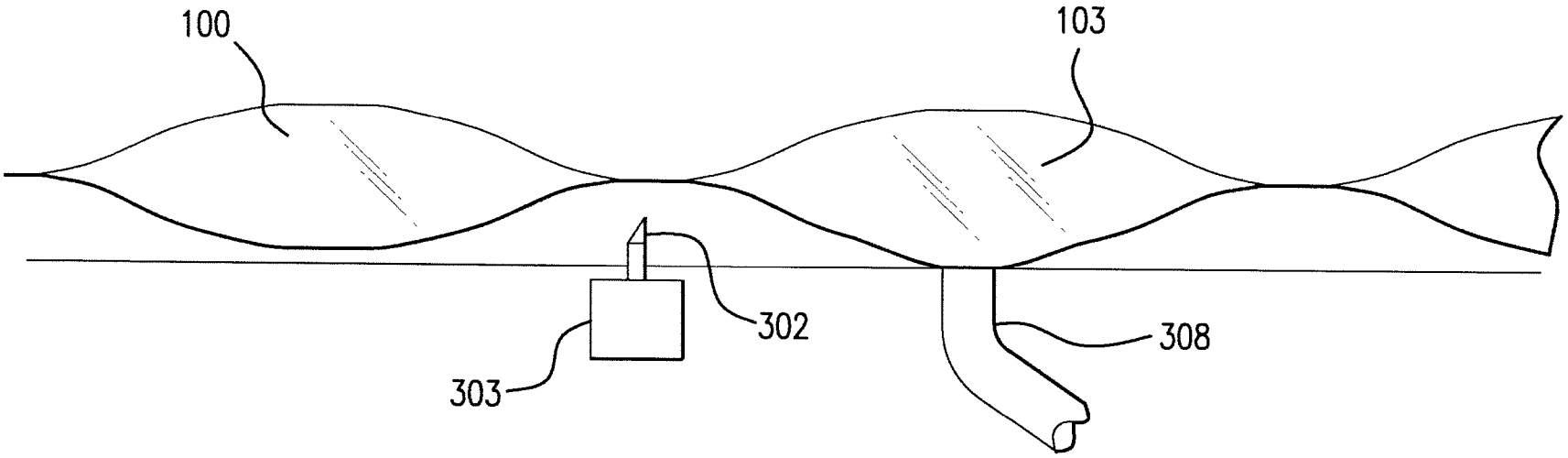
FIGS. 9 and 10 are side views of components of other embodiments of automated transfer and dispensing apparatuses.

In another embodiment of the invention, the location of the perforation 104 between the pillows is identified by the use of a pillow position detector, which can include a sensor, such as a sensor that employs a vacuum directed towards the surface of the pillows 101. As shown in FIG. 9, a tube 308 or other orifice is directed towards the contour of the pillow material and comes in close proximity to the surface of the pillow 101 when the high points of the pillow pass by it. A vacuum is applied to the tube 308 so that negative air pressure is registered when the end of the tube 308 is adjacent to the high points of the pillow contour. However, when the valleys 103 between the pillows 101 pass by the end of the tube 308, the air pressure in the tube 308 changes, thereby identifying the location of the perforated section between the pillows 101. This information is conveyed to the motor controller 20 so that movement of the continuous strip of pillows 100 can be stopped at the proper location. In other embodiments of the invention, other types of sensors can be used in a similar manner to identify the perforated section between the pillows. For example, an optical sensor may be used to identify markings placed on the film material at the perforated sections.

Figure 11:
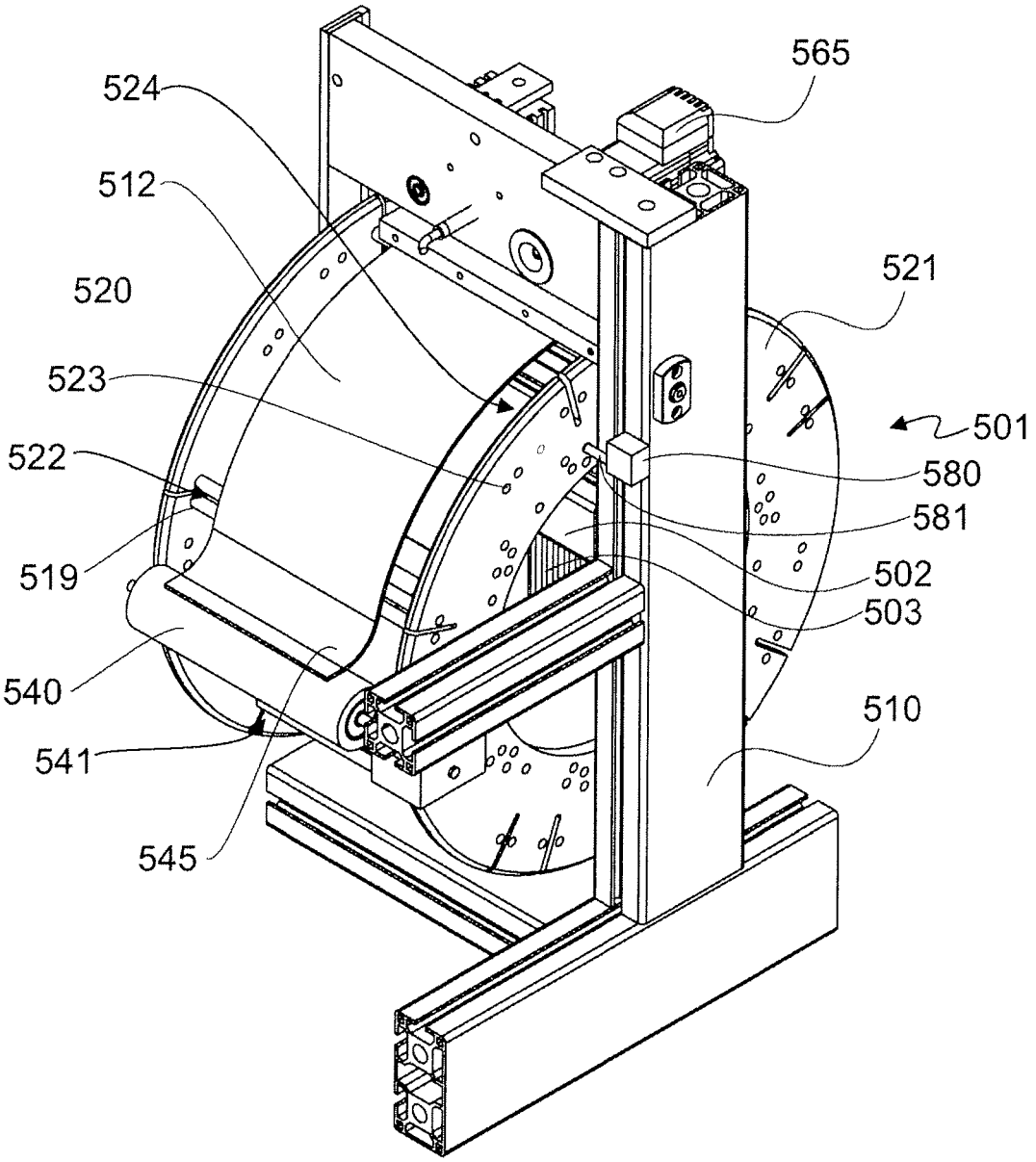
FIGS. 11 and 12 are front and rear side perspective views of an alternative embodiment of an automated transfer and dispensing apparatus.
Figure 12:
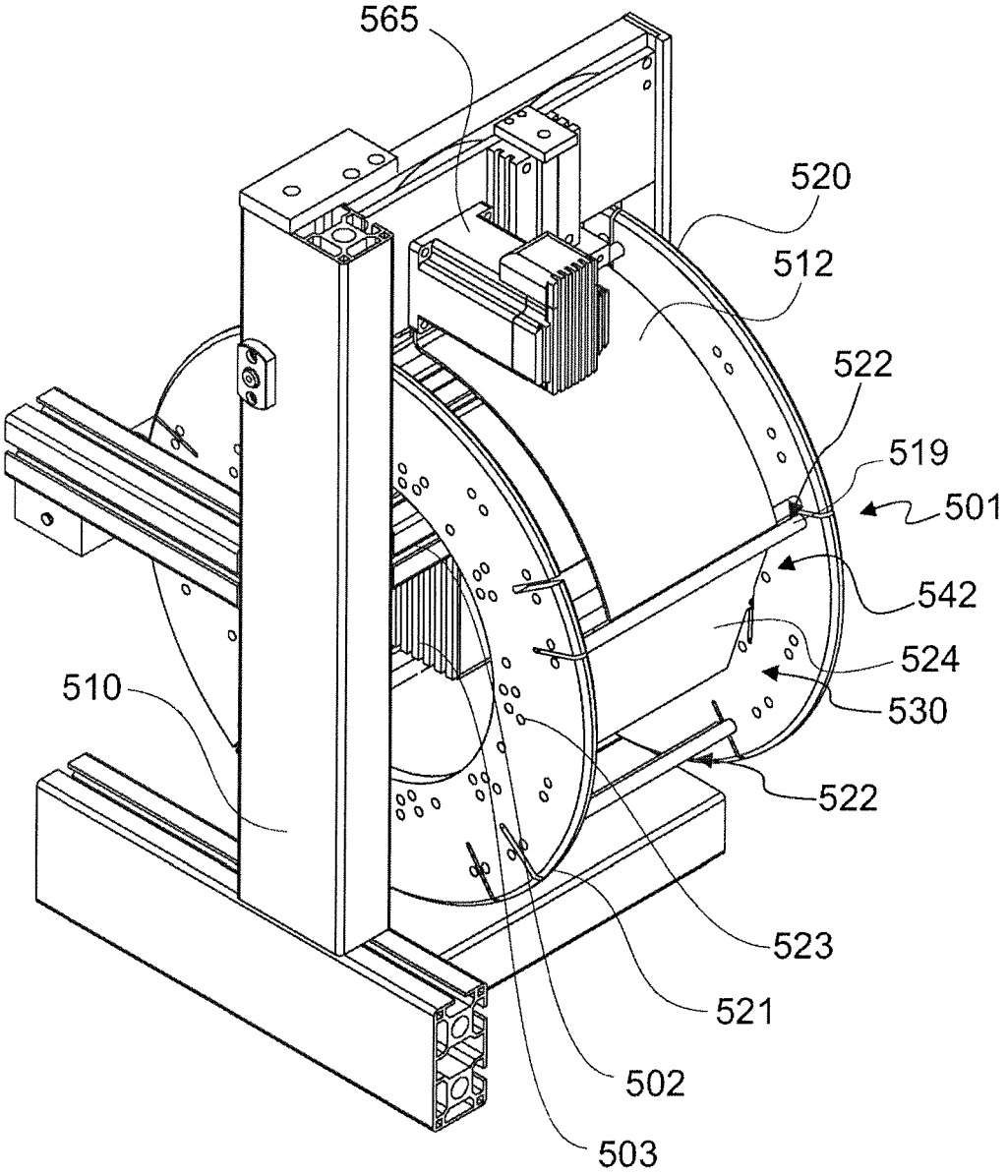
Figure 13A:
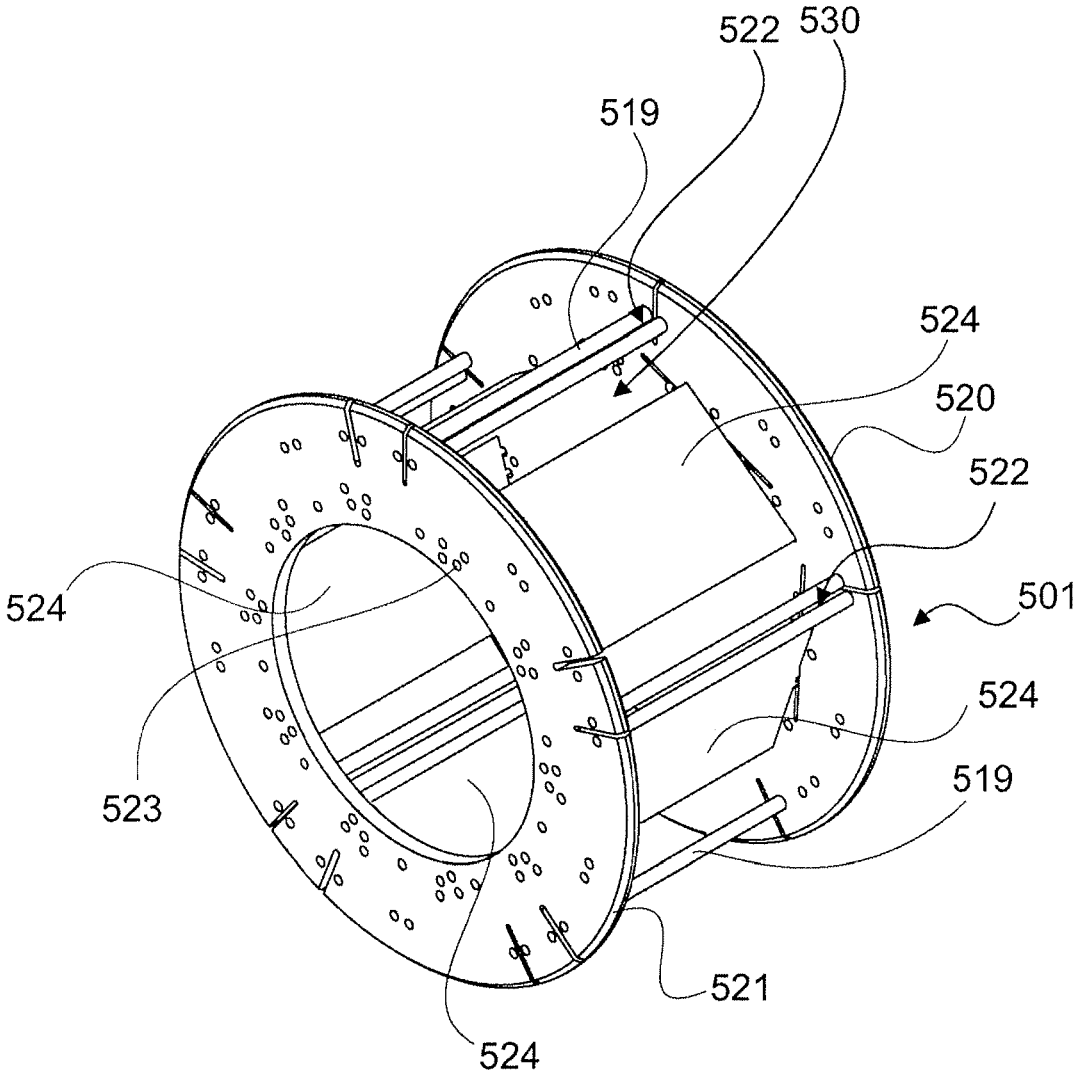
FIG. 13A is a perspective view of a drum thereof.

Another embodiment of the apparatus, illustrated in FIGS. 11-15, incorporates a rotating drum 501 mounted in a support frame 510, to transfer and dispense pillows 101 formed by a pillow inflation and sealing device. The rotating drum 501 rotates about a central axis extending through a central support shaft 502 that extends transversely from the rotating drum 501. The central support shaft 502 is mounted on the support frame 510 and supports the rotating drum 501. The drum 501 is rotated by a drive mechanism 503, for example, a chain or belt driven wheel that is mounted adjacent to the rotating drum 501 and rotates about the central axis of the central support shaft 502. The drive mechanism 503 is operably connected to rotating drum 501 so that the drum 501 rotates when the drive mechanism 503 is driven, for example, by a motor and drive assembly. Preferably, the motor and drive assembly are mounted on the support frame 510. Other methods of driving the rotation of rotating drum 501 are well known in the art and may also be incorporated. The rotating drum 501 is formed from two spaced apart circular plates 520,521 with interior support members, to provide interior support to the pillows, such as rods 519 extending between the plates. The rods 519 are preferably positioned in sets to define pocket areas 530 between the sets, and the pockets 530 are preferably configured to receive formed and inflated pillows 101 to be engaged and held as they are transferred through the apparatus by the rotation of rotating drum 501. Sets of rods 519 are preferably positioned in adjacent pairs, such as pairs of rods 522. Pairs of rods 522 are provided as traction members and can be spaced to receive the valleys 103 between inflated portions 105 of the continuous strip of pillows 100. These pairs of rods 522 can be radially positioned about the center of plates 520,521 near the outer circumference of the plates at a spacing to match the spacing between pillows 101. The pairs of rods 522 are preferably evenly spaced from each other in embodiments that employ pillows of a single configuration. As shown in FIGS. 11-13, other sets of rods 523 may be positioned between circular plates 520,521, being attached to the plates through holes disposed thereabout.

The interior support members can also include biasing members to support the pillows 101 when they are in the pockets. In one embodiment, for example, the biasing members include platforms 524 that are relatively rigid, and which are preferably positioned between the pairs of rods 522, adjacent the pockets 530, and configured to support the inflated portion 105 of the pillows 101 as the pillows are rotated about the drum 501. The platforms 524 can be positioned about the center of the plates 520,521, and are preferably disposed radially inward from the pairs of rods 522. More preferably, the platforms 524 are positioned at least about ½ inch and at most about 4 inches inward from the pairs of rods 522, and more preferably at least 1 inch and at most 2 inches inward from the pairs of rods 522. In this configuration, the platforms 524 deflect the inflated portions 105 of the pillows 101 radially outward to bias the inflated portions 105 of the pillows 101 against an exterior support member, such as outer guide surface 512, to spread the inflated portions laterally due to the air pressure so to facilitate cutting and detachment of the pillows 101. This also helps engage the chain of pillows to more positively draw the chain along the path from input to output of the apparatus. Additionally, once the pilots are detached from each other, the platforms 524 retain the detached pillows 101 against the guide surface 512, preventing them from falling into the center of the drums, so that they can be held by the device until reaching the outlet or output section.

Figure 13B:
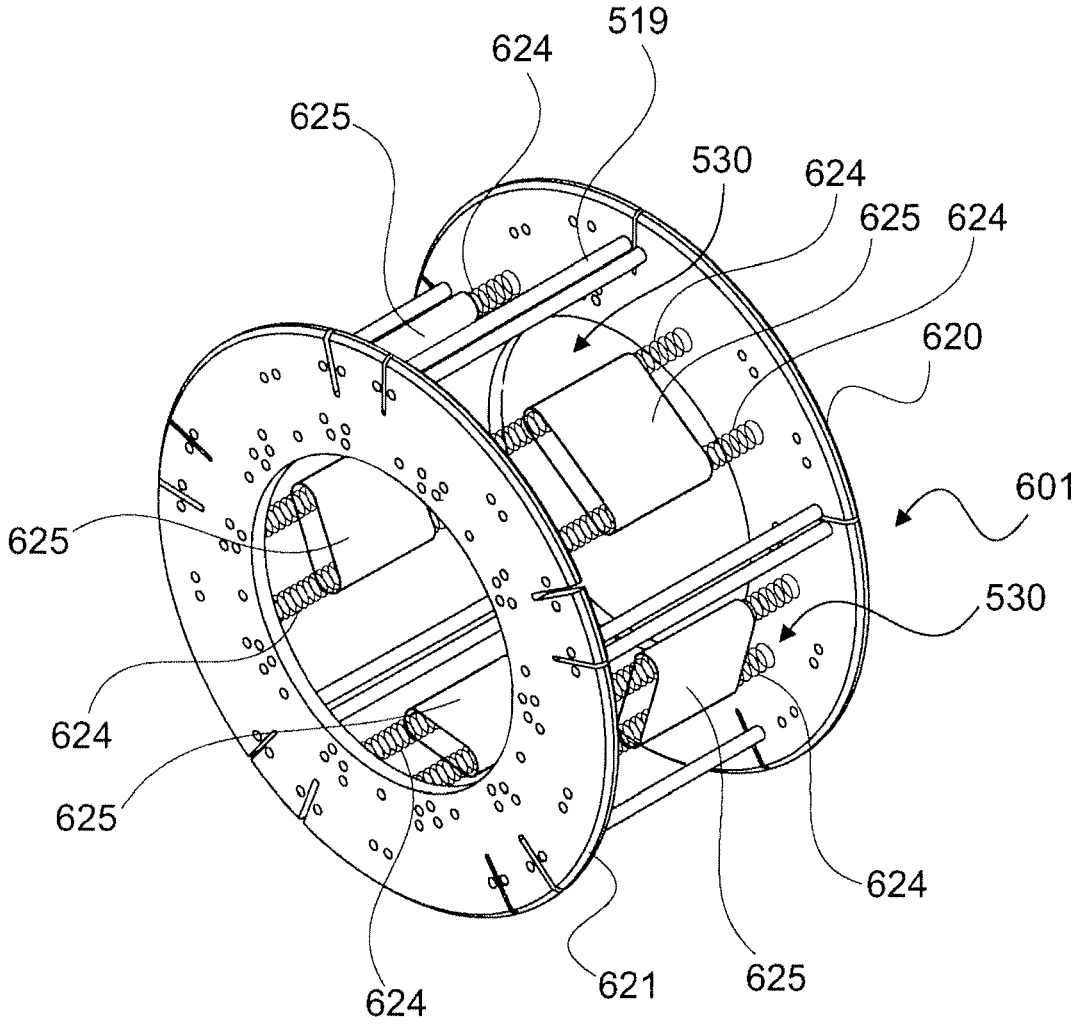
FIG. 13B is a perspective view of another embodiment of a drum with biasing members.

Preferably, the platforms 524 have a concave, such as to shape to match the profile of the inflated pillows 101, but in other embodiments, the platforms can be flat or convex. The platforms can also be discontinuous. In alternative embodiments, biasing members platforms 524 can be replaced or supplemented by at least one, and preferably two, resilient biasing members, as shown in FIG. 13B. Preferably, the biasing members are springs, such as coil springs 624, that are positioned transversely between the circular plates 620, 621 of the drum 601, although other orientations can be used. Similar to the platforms, the biasing members are configured to resiliently deflect the inflated portions 105 of the pillows 101 radially outward. Advantageously, the transverse tension of the biasing members provides a radial give when supporting the pillows 101. The coil springs 624 are preferably connected to each of the plates 620,621 by a retaining member, which can include, for example a pin received in an opening in the plates 620,621, which can be held in place by a transverse pin, such as a cotter pin.

As shown in the embodiment of FIG. 13B, a connecting member 625 can be associated with and disposed between the pair of coil springs 624. The connecting member 625 is preferably flexible, but can alternatively be rigid or semi-rigid, and is preferably a sheet of flexible material, which can be a fabric, plastic, leather, or other material. The connecting member can alternatively have a single layer extending from one spring to the other, and can alternatively comprise one of more strings or ties without a wide flat surface as shown in FIG. 13B. The connecting member 625 is preferably configured for limiting spreading or separating of the pair of coil springs 624 in a circumferential direction so that a pillow 100 does not slip therebetween, and also for providing further biasing support in the radial direction to the inflated portion 105 of the pillow. Preferably, the connecting member 625 is a square shaped centrally disposed between the two plates 620,621 and the pair of coil springs 624, and more preferably the connecting member is between about 1 to 4 inches square. In other embodiments, the pair of coil springs 624 do not have a connecting member associated therewith.

The apparatus of the preferred embodiment also preferably includes a feed roller 540 that is preferably positioned adjacent the feed area 541 where the strip of pillows 100 first engages the drum 501. The feed roller 540 is mounted on the support frame 510 with an axis of rotation that is preferably substantially parallel to the axis of rotation of the drum. The feed roller is configured to direct the strip of pillows 100 into the space 530 between the interior support members 524 and the exterior support member 512 as the strip is fed on the drum 501. In this configuration, the roller 540 can rotate as the chain of pillows 100 passes thereby to smoothly feed the strip 100 onto the drum 501 with the inflated portion 105 of each pillow 101 between the pairs of rods 522. Preferably, the strip of pillows 100 passes below the feed roller 540, but it alternative embodiments, the strip can instead pass over the feed roller depending on the direction from which the pillows are fed to the apparatus.

The apparatus preferably includes a guide 512 that has an exterior support member to cooperate with the interior support members to engage and move the pillows. Guide 512 is mounted at the top of the support frame 510, and preferably has an arcuate surface configured to cover a substantial portion of the top half of the drum 501. In this configuration, the guide 512 can engage and contact the pillows 101 to guide and retain them against the drum as they are rotated thereabout to prevent or substantially reduce the risk of jamming. More preferably, the guide 512 is fixed only to the top of support frame 510 such that front and rear ends of the guide 512, which are preferably adjacent, respectively, the feed area 541 and the dispensing area 542, are radially flexible or displaceable to pivot away from the drum 501 to facilitate and dispensing of the strip of pillows 100. The front end of the guide 512 that is adjacent the feed area 541 preferably includes a curved lip 545 to promote easier reception and engagement of the strip of pillows onto the drum 501.

The combination of the rods 519 and platforms 524 between the plates 520,521 form pockets 530 in which inflated pillows 101 fed into the apparatus are engaged and held. As the rotating drum 501 rotates, the continuous strip of pillows 100 is drawn into the feed area 541 of the apparatus and moves through the apparatus. As each pillow 101 moves through the apparatus towards the dispensing area 542, a dispensing member, which is preferably a finger formed by a fixed plate and positioned to extend perpendicularly through portions of platform 524 as they move past the fixed plate, "pushes" the pillow 101 out of the pocket 530, thereby dispensing the pillow 101 at the dispensing area 542.

Figure 14:
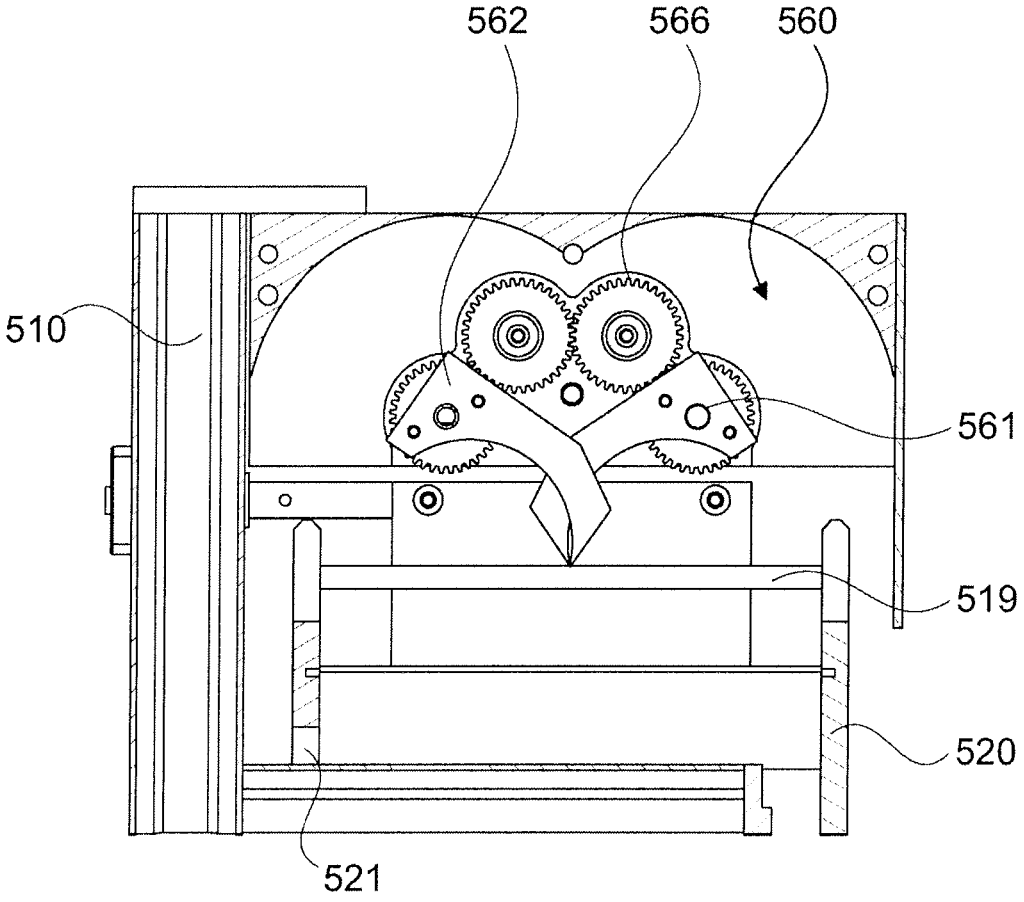
FIG. 14 is a rear, cut-away view of a cutting mechanism of the transfer and dispensing apparatus of FIGS. 11 and 12.
Figure 15:
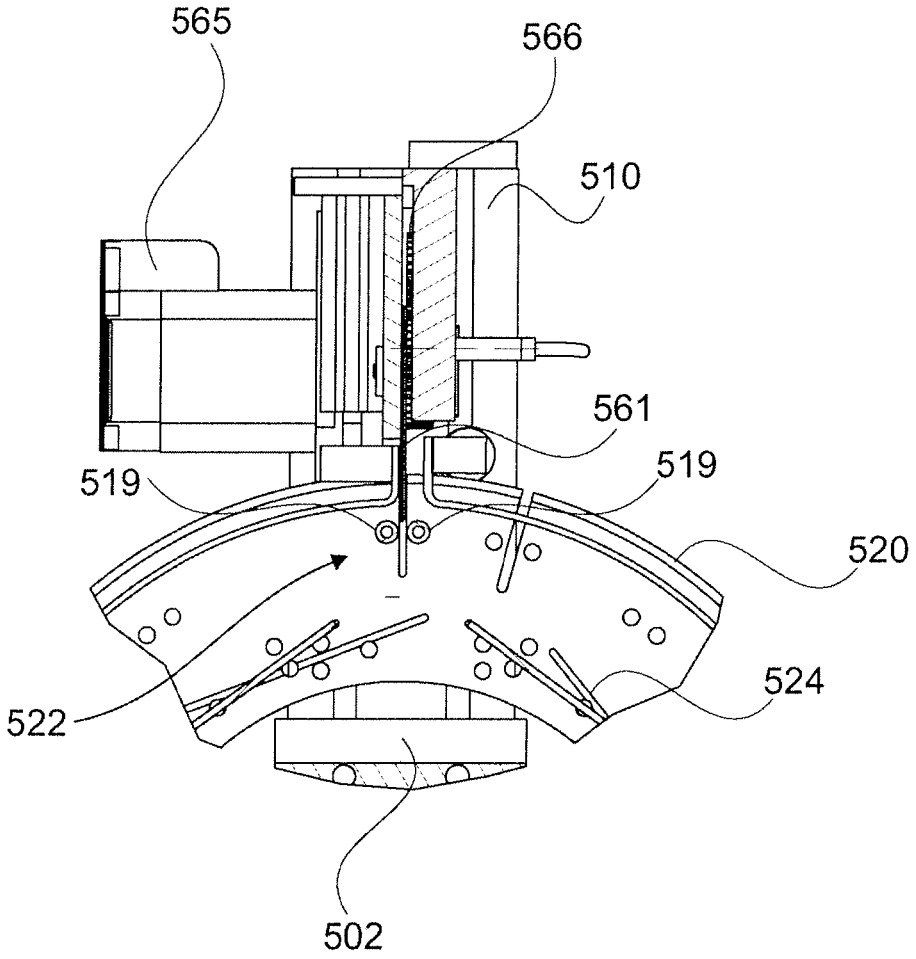
FIG. 15 is a side, cut-away view thereof.

Referring to FIGS. 14 and 15, the apparatus preferably includes a detachment mechanism 560 configured for detaching and separating the pillows 101 at their respective perforations 104. The detachment mechanism 560 is preferably mounted to the support frame 510 above the drum 501. The detachment mechanism 560 includes at least one detachment element, such as a cutter, and more preferably a pair of cutters 561,562, as shown in FIG. 14. The detachment mechanism is configured for cutting, piercing, or otherwise detaching adjacent pillows 100 at a perforations 104. The cutters 561,562 are preferably configured for rotating downwardly through the strip 100 in opposing directions (e.g., cutter 561 rotating counterclockwise and cutter 562 rotating clockwise), preferably substantially transversely to the path in which the pillows are drawn through the apparatus. The cutters 561,562 cooperatively puncture the perforated or otherwise weakened region 104, preferably at a central portion, and move through the perforated region outwardly to completely separate the strip at the perforation. The outward, opposing movement of the cutters cooperatively pulls the material that is being cut against the opposing cutter. As shown in FIG. 15, the cutters 561,562 are configured to pass between a pair of rods 522 as they rotate to separate the strip. The rods 519 in each pair of rods 522 are preferably closely spaced to allow the longitudinally overlapping cutters to pass therebetween while closely supporting the adjacent pillow chain material. As shown in FIGS. 14 and 15, the detachment mechanism 560 is preferably positioned above the drum such that the cutters 561,562 first engage and puncture the strip of pillows 100 about three-quarters of the way along the path of their downward stroke. In an alternative embodiment, the detachment mechanism can be disposed within the drum, such as by mounting on the drum drive-shaft.

Figure 17:
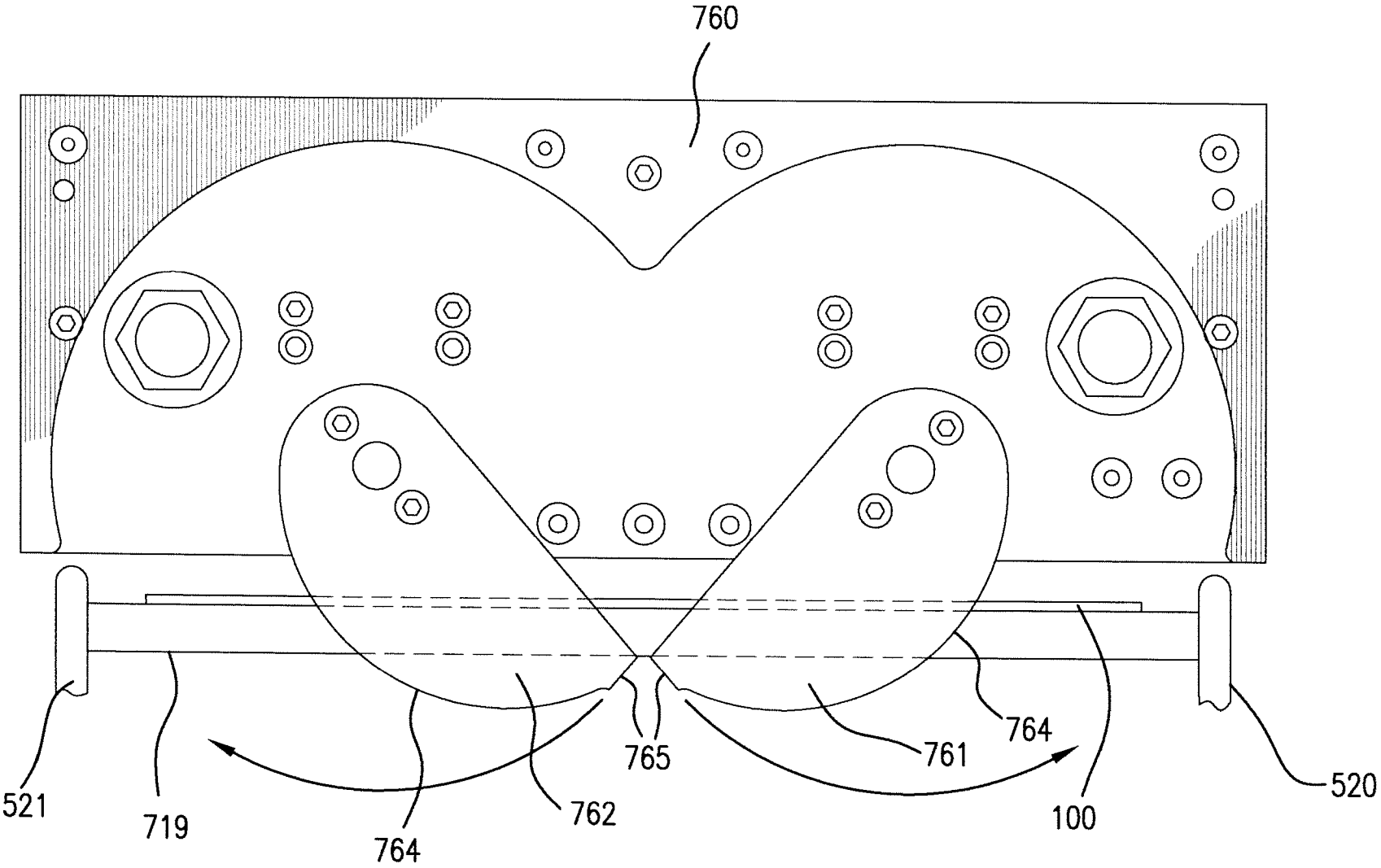
FIG. 17 is rear view of another embodiment of a cutting mechanism.

FIG. 17 shows another preferred embodiment of the cutters 761,762 of detachment mechanism 760. The cutters 761,762 are configured for rotation in the downward direction in opposing directions through the film of the pillow chain, preferably substantially transversely to the path in which the pillows are drawn through the apparatus. The edges of the cutters 761,762 that engage and separate the pillows preferably are blunt or rounded, most preferably without any sharp edges. The cutters 761,762 include a major curved edge 764 and a blunt, preferably squared, reflex tip 765. Thus, as the cutters 761,762 are rotated downward into the film, the major edge 764 of the cutters first engages and punctures the perforation 104 as they bias the material downward against the internal support members to break the perforation as the film on either side thereof is supported by the internal support members. The reflex tip 765 can then catch any remaining or intact portions of the perforation 104, such as at the lateral edges of the film, during the upward rotation of the cutters for tearing and completing separation of the pillows 101. The reflex tip can catch both edges and tear them by biasing them away from each other. In other embodiments, the detachment element can include other shapes and configurations that are effective for separating the perforations.

The detachment mechanism 560 also includes a motor 565 or other suitable drive mechanism that can drive a transmission 566 to operate the cutters. The cutters 561,562 are driven to rotate to the strip of pillows. In one embodiment, the apparatus includes a controller that is preferably associated with the detachment mechanism, drive mechanism, sensor, and drum for controlling the rotation of the drum and operation of the detachment mechanism.

As the strip of pillows 100 is rotated through the apparatus, the strip is separated by the detachment mechanism 560 depending on the desired length of pillows that is required to be dispensed. For example, the strip of pillows 100 is engaged and held against the drum 501 such that the inflated portions 105 of each pillow 100 are held within the pockets 530, and the valleys 103 between the pillows 101 are positioned adjacent the pairs of rods 522. Preferably, each perforation 104 at the valley 103 is disposed over and between the pair of rods 522. Thus, when a specific length of pillows is desired, the controller of the apparatus preferably rotates the drum 501 adjacent to the detachment mechanism 560 such that the pair of rods 522 and the perforation 104 disposed thereover is aligned with the cutters 561,562. The controller then operates the detachment mechanism 560 to rotate the cutters 561,562 to engage and separate the strip 100 at the perforation 104.

While the various embodiments of the detachment mechanism described above have been found to be particularly effective and beneficial for separating strips of pillow that are transported through the transfer and dispensing apparatus of the present invention, it can be readily appreciated that the detachment mechanism can also be used in conjunction with other devices, such as pillow manufacturing machines or other preformed film handling devices, for separating strips of pillows, such as disclosed, for example in U.S. Pat. No. 6,932,134, the disclosure of which is hereby incorporated herein by reference thereto, in which the detachment mechanism can be used to break off a length of an inflated-pillow chain. Also, an alternative embodiment can be provided without cutters or alternatively without another detachment mechanism, and the pillows can be detached simply by tearing them from each other by hand, or by pulling the protruding pillow from the apparatus.

Figure 16:
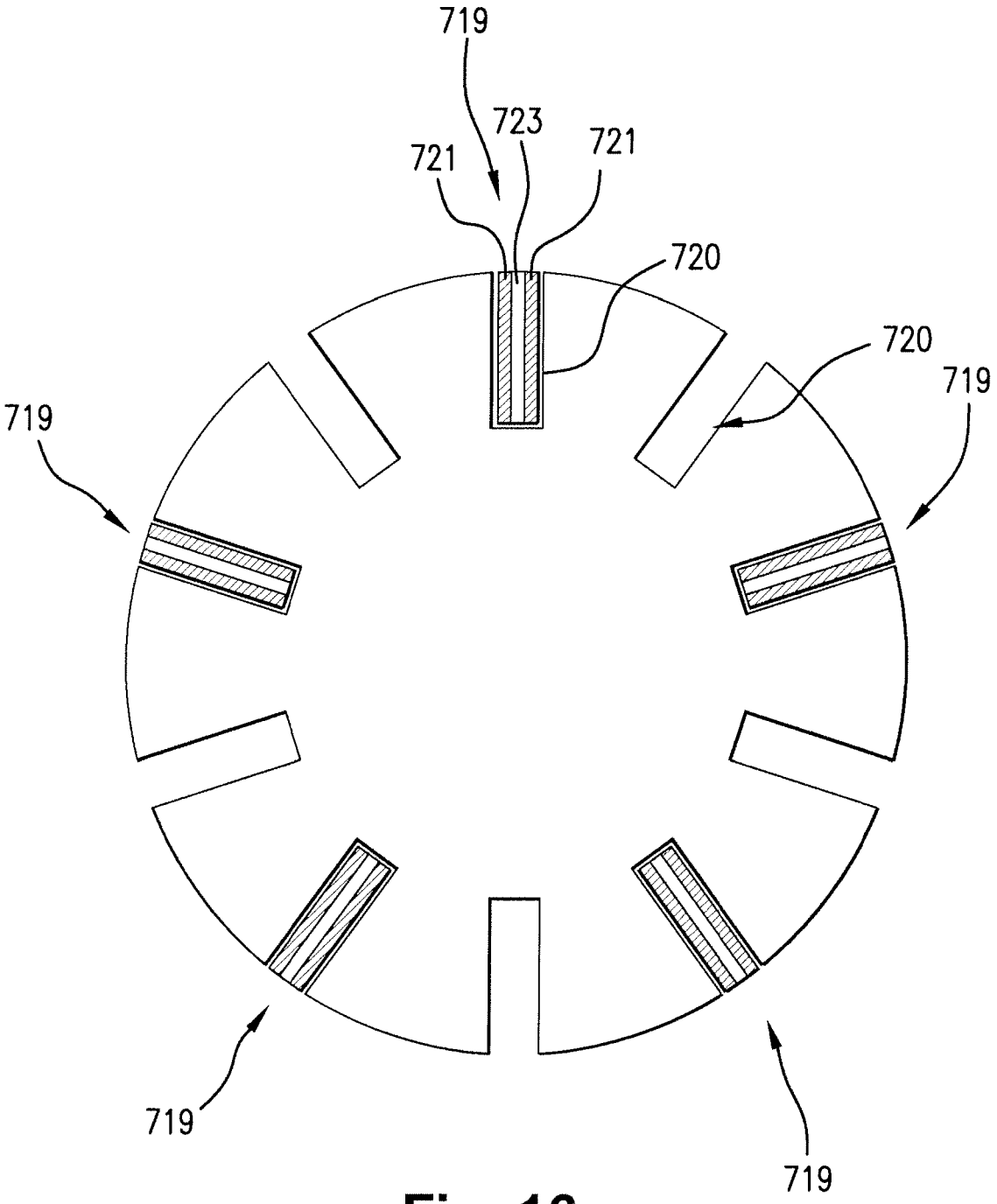
FIG. 16 is a side view of another embodiment of a drum with biasing members of an automated transfer and dispensing apparatus.

In another embodiment, as shown in FIG. 16, the internal support members of the drum include fixed or removable bar members 719 instead of pairs of rods 619. The bar members 719 preferably include a pair of rigid slats 721 that extend the length of the bar member 719 and define a spacing 723 therebetween. The bar members 719 are configured for extending between the plates, and similar to the pairs of rods 619, are preferably radially positioned about the center of the plates near their outer circumference to define pocket areas for receiving formed and inflated pillows 101. Preferably, the bar members are retained in slots 720 of each of the plates, and in one embodiment, the bar members are magnetically retained in the slots, such as by a magnet and a ferrous material operatively associated on the bar member and plates. The bar members 719 are be spaced to receive the valleys 103 between inflated portions 105 of the continuous strip of pillows 100, with the perforations 104 generally disposed over and aligned with the spacing 723. The bar member 719 is thus configured for allowing the detachment element of the detachment mechanism to pass between the slats 721 and within the spacing 723 to engage and cut the perforation 104 between adjacent pillows 101 when the drum is rotated to position the bar member 719 adjacent the detachment mechanism. The slots can be circumferentially spaced at selected intervals, which can be regular or irregular. The removable bar members can be placed in all or fewer than all of the slots according to the distance between pillows to be detached, or to accommodate a predetermined number of pillows to be detached. In one embodiment, the slots are positioned at 2 inches radially from each other, so optional supported longitudinal lengths of pillow chains that can be accommodated between the internal support members include multiples of 2 inches.

In alternative embodiments, the drum is adjustable such that it can be configured to accommodate pillows 101 of varying dimensions. In one embodiment, the drum can be configured to handle chains of pillows having different lateral widths. For example, a drum can be configured to handle chains of pillows having lateral widths of both 8 inches and 10 inches. This is preferably done by adjusting the spacing between the circular plates of the drum, or by inserting a spacer member adjacent to one of the plates to account for the decrease in lateral width of a chain of pillows.

Additionally, the drum can also be adjusted to handle chains of pillows having different length of pillows, as defined by the perforation-to-perforation length of the chain. For example, one embodiment of a drum can include pairs of rods spaced about the drum that are configured to engage the perforations between pillows having a perforation-to-perforation length of about 8 inches. However, the same drum can also be reconfigured to engage a strip of pillows that have a perforation-to-perforation length of, for example, about 4 inches. To achieve this, additional internal support members are attached about the drum (i.e. between the circular plates) and in between existing pairs of internal support members. In this configuration, the additional pairs of bars define pockets that can accommodate a strip of pillows having a perforation-to-perforation length of about 4 inches rather than 8 inches. The controller can then be set to stop the rotation of the drum in a position such that the any of the pairs of internal support members are adjacent detachment mechanism. As described above, the controller can operate the detachment mechanism to rotate the cutters to engage and separate the strip of pillows at any of the perforations.

In another embodiment, the drum is adjustable to handle chains of pillows having different pillow depths, for example, of pillows inflated to different internal pressures or having different configurations. To achieve this, the biasing members (e.g. the platforms or springs) can be adjusted and repositioned about the circular plates.

In other embodiments, the pairs of bars, the biasing members, and the circular plates can be adjusted as desired such that the drum can accommodate pillows of any dimension.

Preferably, the drum 501 is locked during activation of the detachment mechanism 560 to prevent the drum from rotating while the strip is being separated. For example, the apparatus may include a locking mechanism such as a solenoid 580 that is controlled by the controller to move a locking member 581 to engage one or both of the plates and prevent rotation of the drum during detachment of the strip. After detachment is complete, the controller preferably operates the locking mechanism to disengage the locking member, and the drum can rotate to dispense the length of pillows from the apparatus.

Figure 18A:
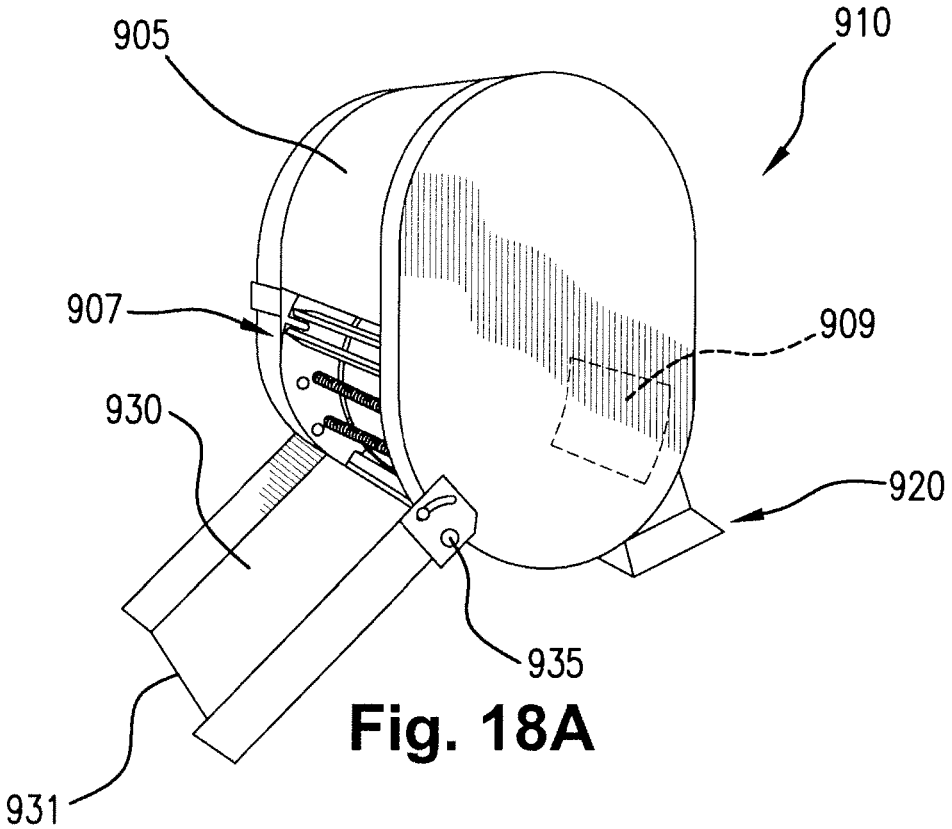
FIGS. 18A and 18B are perspective and side views of another embodiment of an automated transfer and dispensing apparatus.
Figure 18B:
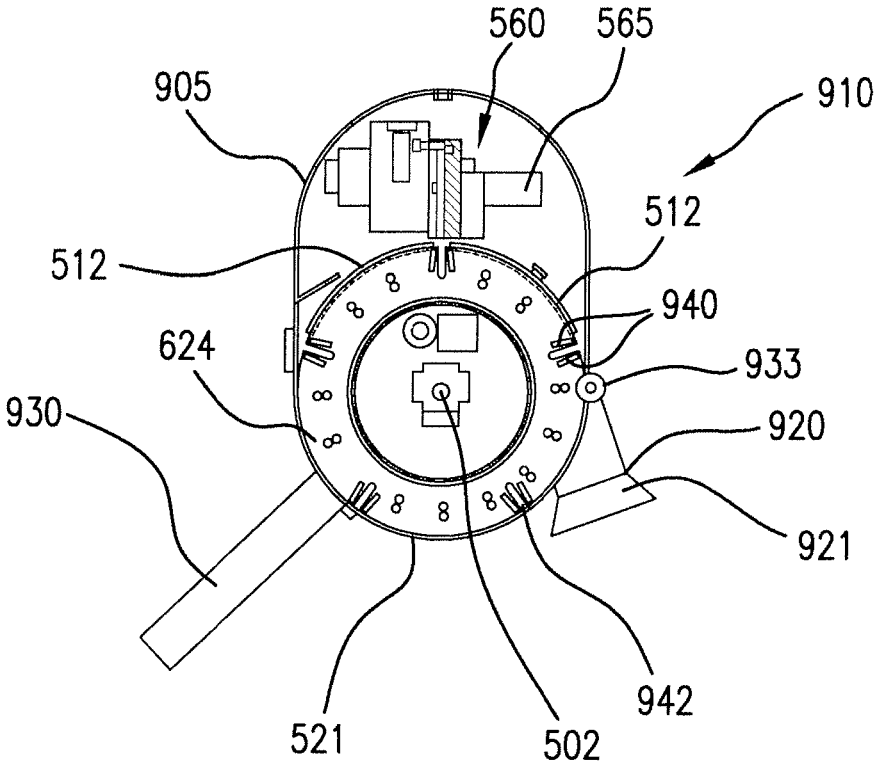
Figure 19:
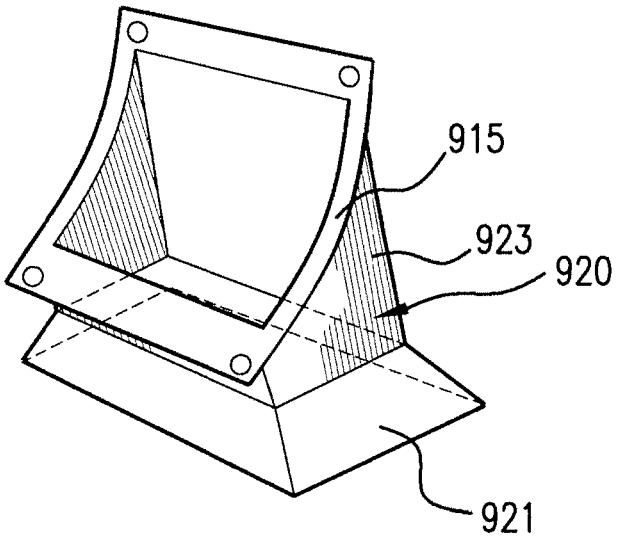
FIG. 19 is a perspective view of one embodiment of an intake funnel.

In yet another embodiment shown in FIGS. 18A, 18B, and 19, the apparatus 910 also includes an intake member 920 and an output member 930 for more easily facilitating entry and exit of the strip of pillows 100 into and from the apparatus. For example, the intake member 920 can be an intake funnel 922, which is preferably aimed upwardly into the housing 905 and includes a flared bottom skirt 921, which faces upstream and is preferably flared radially about its periphery. The intake member enables easier engagement of the pillow strip 100 onto the drum because the strip does not have to be exactly aligned and centered with the apparatus 910 in order for the pillows to be properly seated on the drum. Additionally, the orientation of the funnel 922 and intake throat 923 of the intake member with respect to the apparatus directs and aligns the pillow chain for generally tangential movement and engagement of the strip 100 onto the rotating drum for easier seating of the pillows thereon. The intake funnel 922 preferably includes an attachment portion, such as a flange 915, that is configured for removable attachment to the housing of the apparatus 910, as shown in FIG. 19. The housing 905 encloses the drum and the detachment mechanism, and includes an intake opening 907 to receive a pillow chain from the intake member 920 and an output opening 909 to outlet pillows to the output member 930.

The output member 930 can include a guide chute 931 that is preferably attached adjacent to the output area of the apparatus housing, and more preferably generally adjacent and below the horizontal end portion of the drum, so that the dispensed strip of pillows 100 can naturally fall onto the chute 931, which directs the strip away from the apparatus as desired. The guide chute 931 is also preferably removably and adjustably attached to the housing of the apparatus 910, for example by retaining members or pins, so that the angle of the guide chute 931 relative to the apparatus 910 can be adjusted as desired. The chute can have side walls to direct the pillow chain to keep it on the chute in a lateral direction. An optional guide roller 933 can be disposed near the end of the intake member and the exterior support member 512 to help position and engage the pillow chain onto the drum.

The internal support members of FIG. 18B are preferably removable, and include first and second bars 940 inclined with respect to lateral slots 942 in the side walls of the plates 620,621. The slots 942 are aligned with the opening between the bars 940 and with the path of the cutters as they rotate laterally past the plates 620,610. Bars 940 are preferably inclined towards each other at their radially-outward ends.

It will be apparent to those skilled in the art that various modifications and variations can be made in the method and system of the present invention without departing from the spirit or scope of the invention. For example, the detachment mechanism preferably completely detaches the dispensed pillow or pillows, but can alternatively initiate detachment or partially detach the pillow or pillows to facilitate final detachment by the user. Also, the components of the various embodiments can be interchanged with other embodiments. Thus, it is intended that the present invention include modifications and variations that are within the scope of the appended claims and their equivalents.

What is claimed is:

1. A packaging material transfer apparatus for transferring a chain of pre-inflated pillows connected to each other end to end, the packaging material transfer apparatus comprising:

a driving mechanism configured to receive the chain of pre-inflated pillows and including a traction member that extends laterally, in a first direction, with respect to the chain of pre-inflated pillows received by the driving mechanism to engage recessed zones of the chain of pre-inflated pillows disposed between inflated portions of the chain of pre-inflated pillows, the driving mechanism driving the traction member in rotation to move the chain of pre-inflated pillows along a curved path perpendicular to the first direction; and an exterior support member disposed on a radially exterior side of the traction member with respect to the rotation of the traction member and configured to support the chain of pre-inflated pillows in the engagement with the traction member and guide the chain of pre-inflated pillows along the curved path.

2. The transfer apparatus of claim 1, wherein the traction member further comprises a plurality of traction members.

3. The transfer apparatus of claim 2, wherein the traction members are spaced circumferentially with respect to the rotation thereof at a predetermined distance from each other corresponding to the recessed zones of the chain of pre-inflated pillows disposed, the traction members defining pockets therebetween, the pockets being configured to, during operation, receive the inflated portions of the chain of pre-inflated pillows.

4. The transfer apparatus of claim 1, wherein the exterior support member has a concave guide surface associated with the driving mechanism and configured to, during operation, support the chain of pre-inflated pillows from the radially exterior side of the driving mechanism.

5. The transfer apparatus of claim 3, wherein the traction members are disposed so that, during operation, the traction members simultaneously engage a plurality of the recessed zones of the chain of pre-inflated pillows.

6. The transfer apparatus of claim 1, wherein the exterior support member comprises an arcuate concave guide surface configured to, during operation, guide the chain of pre-inflated pillows therealong.

7. The transfer apparatus of claim 1, wherein the exterior support member is further configured to, during operation, engage and contact the chain of pre-inflated pillows to guide and retain the chain of pre-inflated pillows against the traction member as the chain of pre-inflated pillows is moved along the curved path.

8. The transfer apparatus of claim 1, wherein the driving mechanism further comprises a wheel driven in rotation.

9. A packaging system, comprising:

a chain of pre-inflated pillows connected to each other end to end; and a packaging material transfer apparatus for transferring the chain of pre-inflated pillows, the packaging material transfer apparatus comprising:

a driving mechanism comprising a traction member that extends laterally, in a first direction, with respect to the chain of pre-inflated pillows received by the driving mechanism and configured to engage recessed zones of the chain of pre-inflated pillows disposed between inflated portions of the chain of pre-inflated pillows to move the chain of pre-inflated pillows along a curved path perpendicular to the first direction; and an exterior support member associated with the driving mechanism and configured to support the chain of pre-inflated pillows from the driving mechanism and guide the chain of pre-inflated pillows along the curved path.

10. The transfer apparatus of claim 9, wherein the exterior support member is further configured to, during operation, support the chain of pre-inflated pillows from a radially exterior side of the driving mechanism.

11. The transfer apparatus of claim 9, wherein the driving mechanism further comprises a plurality of traction members.

12. The transfer apparatus of claim 11, wherein the traction members are driven in rotation and are spaced circumferentially about the driving mechanism at a predetermined distance from each other corresponding to the recessed zones of the chain of pre-inflated pillows, the traction members being further configured to, during operation, engage the recessed zones and move the chain of pre-inflated pillows.

13. The transfer apparatus of claim 10, wherein the exterior support member has a concave guide surface associated with the driving mechanism and configured to, during operation, support the chain of pre-inflated pillows from the radially exterior side of the driving mechanism.

14. The transfer apparatus of claim 13, wherein the traction members are disposed to simultaneously engage a plurality of the recessed zones of the chain of pre-inflated pillows.

15. The transfer apparatus of claim 9, wherein the exterior support member comprises an arcuate concave guide surface configured to, during operation, guide the chain of pre-inflated pillows therealong.

16. The transfer apparatus of claim 9, wherein the exterior support member and the curved path are concentric.

17. The transfer apparatus of claim 9, wherein the driving mechanism further comprises a wheel driven in rotation.

18. A packaging material transfer apparatus for transferring a chain of pre-inflated pillows connected to each other end to end, the packaging material transfer apparatus comprising:

a driving mechanism configured to receive the chain of pre-inflated pillows and including: a plurality of tractions members that extend laterally with respect to the chain of pre-inflated pillows received by the driving mechanism to engage recessed zones of the chain of pre-inflated pillows disposed between inflated portions of the chain of pre-inflated pillows; and first and second laterally spaced plates, wherein:

the traction members are spaced circumferentially with respect to the rotation thereof at a predetermined distance from each other corresponding to the recessed zones of the chain of pre-inflated pillows disposed;

the driving mechanism drives the traction members in rotation to move the chain of pre-inflated pillows along a curved path;

the traction members extend from the first to the second plate; and the first and second plates define a pocket area configured to, during operation, receive the inflated portions of the chain of pre-inflated pillows laterally therebetween; and an exterior support member disposed on a radially exterior side of the traction member with respect to the rotation of the traction members and configured to support the chain of pre-inflated pillows in the engagement with the traction members and guide the chain of pre-inflated pillows along the curved path.

19. A packaging material transfer apparatus for transferring a chain of pre-inflated pillows connected to each other end to end, the packaging material transfer apparatus comprising:

a driving mechanism configured to receive the chain of pre-inflated pillows and including a plurality of traction members that extend laterally with respect to the chain of pre-inflated pillows received by the driving mechanism to engage recessed zones of the chain of pre-inflated pillows disposed between inflated portions of the chain of pre-inflated pillows, wherein:

the driving mechanism drives the traction members in rotation to move the chain of pre-inflated pillows along a curved path;

the traction members each define a transverse slot for operation of a detachment element moving therethrough; and each of the traction members is configured to, during operation, support the chain of pre-inflated pillows on opposite longitudinal sides of a weakened area of the recessed zones of the chain of pre-inflated pillows; and an exterior support member disposed on a radially exterior side of the traction members with respect to the rotation of the traction members and configured to support the chain of pre-inflated pillows in the engagement with the traction members and guide the chain of pre-inflated pillows along the curved path.

20. A packaging material transfer apparatus for transferring a chain of pre-inflated pillows connected to each other end to end, the packaging material transfer apparatus comprising:

a driving mechanism configured to receive the chain of pre-inflated pillows and including:

a traction member that extends laterally with respect to the chain of pre-inflated pillows received by the driving mechanism to engage recessed zones of the chain of pre-inflated pillows disposed between inflated portions of the chain of pre-inflated pillows, the driving mechanism driving the traction member in rotation to move the chain of pre-inflated pillows along a curved path; and a wheel driven in rotation;

an exterior support member disposed on a radially exterior side of the traction member with respect to the rotation of the traction member and configured to support the chain of pre-inflated pillows in the engagement with the traction member and guide the chain of pre-inflated pillows along the curved path; and a support frame, wherein:

the wheel is mounted in the support frame; and the exterior support member is fixed only to a top of the support frame such that front and rear ends of the exterior support member are radially flexible or displaceable to, during operation, pivot away from the wheel to facilitate dispensing of the chain of pre-inflated pillows.

21. The transfer apparatus of claim 9, wherein the exterior support member is disposed on a radially exterior side of the traction member with respect to the rotation of the traction member and is configured so that the chain of pre-inflated pillows remains entirely radially inward of the exterior support member as the exterior support member guides the chain of pre-inflated pillows along the curved path.

22. The transfer apparatus of claim 9, wherein the exterior support member is disposed on a radially exterior side of the traction member with respect to the rotation of the traction member and is configured so that the exterior support member contacts and covers the pre-inflated pillows to guide the chain of pre-inflated pillows along the curved path.

23. The transfer apparatus of claim 1, wherein the exterior support member is spaced apart radially from the traction member when the chain of pre-inflated pillows is not located on the curved path.

* * * * *